US009511387B2

(12) United States Patent
Keren et al.

(10) Patent No.: US 9,511,387 B2
(45) Date of Patent: Dec. 6, 2016

(54) ROTATING SPRINKLER

(71) Applicant: Netafim, Ltd., Tel Aviv (IL)

(72) Inventors: Ron Keren, Kibbutz Hatzerim (IL); James Belford, Kibbutz Magal (IL); Gad Peleg, Kibbutz Hulda (IL)

(73) Assignee: Netafim, Ltd., Tel Aviv (IL)

( * ) Notice: Subject to any disclaimer, the term of this patent is extended or adjusted under 35 U.S.C. 154(b) by 17 days.

(21) Appl. No.: 14/404,824

(22) PCT Filed: Jun. 27, 2013

(86) PCT No.: PCT/IB2013/055298
§ 371 (c)(1),
(2) Date: Dec. 1, 2014

(87) PCT Pub. No.: WO2014/002056
PCT Pub. Date: Jan. 3, 2014

(65) Prior Publication Data

US 2015/0115056 A1 Apr. 30, 2015

Related U.S. Application Data

(60) Provisional application No. 61/665,449, filed on Jun. 28, 2012.

(51) Int. Cl.

| | |
|---|---|
| ***B05B 3/04*** | (2006.01) |
| ***B05B 3/06*** | (2006.01) |
| ***B05B 3/16*** | (2006.01) |
| ***B05B 12/06*** | (2006.01) |
| ***B05B 15/10*** | (2006.01) |

(52) U.S. Cl.
CPC ..... *B05B 12/06* (2013.01); *B05B 3/049* (2013.01); *B05B 3/06* (2013.01); *B05B 3/16* (2013.01); *B05B 15/10* (2013.01)

(58) Field of Classification Search
CPC ..... B05B 3/04; B05B 3/06; B05B 3/16; B05B 3/049; B05B 12/06; B05B 15/10; A01G 25/165
USPC ..... 239/251, 99, 570, 200–206, 67–68
See application file for complete search history.

(56) References Cited

U.S. PATENT DOCUMENTS 1,665,371 A * 4/1928 Keys ..... B05B 3/06 239/206
1,919,243 A * 7/1933 Munz ..... B05B 3/0404 239/206
3,655,132 A * 4/1972 Rosic ..... B05B 15/10 239/206
3,767,119 A * 10/1973 Tibbals, Jr. ..... B05B 1/08 239/251

(Continued)

OTHER PUBLICATIONS

International Search Report in PCT/IB2013/055298, dated Oct. 29, 2013.
Written Opinion in PCT/IB2013/055298, dated Oct. 29, 2013.

*Primary Examiner* — Arthur O Hall
*Assistant Examiner* — Joseph A Greenlund
(74) *Attorney, Agent, or Firm* — Womble Carlyle

(57) ABSTRACT

A rotating sprinkler for intermittently emitting a liquid supplied by a pulsating device that forms pulses that have a beginning and an end. The sprinkler has a rotating portion that can rotate about an axis while emitting the liquid pulses to the outside environment. The sprinkler provides for rotation of the rotating portion during a portion of each pulse and for stopping rotation of the rotating portion during another portion of the pulse.

14 Claims, 14 Drawing Sheets

(56) References Cited

U.S. PATENT DOCUMENTS 4,919,797 A * 4/1990 Chupka ..... D21D 5/026 209/273
4,939,797 A * 7/1990 Goettl ..... E04H 4/169 134/167 R
4,949,747 A * 8/1990 Rosenberg ..... A01G 25/165 137/107
5,213,261 A * 5/1993 Rosenberg ..... B05B 15/10 239/205
5,251,343 A * 10/1993 Goettl ..... B05B 15/10 239/204
5,314,116 A * 5/1994 Krauth ..... B05B 12/06 239/533.13
5,611,488 A * 3/1997 Frolich ..... B05B 3/0436 239/242
5,803,365 A * 9/1998 Ruttenberg ..... B05B 1/083 239/101
7,070,123 B2 * 7/2006 Naedler ..... B05B 3/026 239/251
7,644,870 B2 * 1/2010 Alexander ..... B05B 3/0431 239/1
7,900,851 B2 * 3/2011 Ruttenberg ..... B05B 1/086 239/203
8,074,897 B2 * 12/2011 Hunnicutt ..... B05B 3/003 239/204
9,016,315 B2 * 4/2015 Ensenat De Carlos ... B05B 3/04 137/624.14
2006/0054716 A1 * 3/2006 Lutzki ..... B05B 3/005 239/246
2007/0221750 A1 * 9/2007 Roberts ..... A01G 25/16 239/200
2012/0312894 A1 * 12/2012 Keren ..... B05B 1/086 239/101
2014/0138453 A1 * 5/2014 Keren ..... B05B 12/06 239/1

* cited by examiner

ROTATING SPRINKLER

RELATED APPLICATIONS

This is a 35 USC 371 U.S. National Phase of International Application No. PCT/IB2013/055298, filed 27 Jun. 2013 and published in English as WO 2014/002056A1 on 3 Jan. 2014, which claims priority to U.S. Provisional application No. 61/665,449, filed 28 Jun. 2012. The contents of aforementioned applications are incorporated by reference in their entirety.

TECHNICAL FIELD

Embodiments of the invention relate to a rotating sprinkler for use with a pulsating device.

BACKGROUND

In pulsating devices such as those used in irrigation systems, an incoming relatively low flow of liquid is transformed to an ejected pulse of liquid at a relatively high flow. Pulses emitted by pulsating devices can therefore be designed to reach relative large distances in relation to conventional non pulsating devices that would otherwise require much higher incoming flow rates in order to reach similar distances.

For distributing the liquid emitted from a pulsating device to a field a rotating sprinkler may be used. However, the relatively high flow rate of the emitted pulses may urge the sprinkler to rotate at a relatively high speed during each pulse resulting in the emitted pulses being sprayed to shorter distances.

U.S. Pat. No. 5,314,116 describes a pulsating device used in irrigation systems that discharges intermittent pulses of liquid. The pulsating device intermittently discharges the liquid to a distributor, such as an irrigation rotary sprayer to form a sprayed pattern that can be varied by varying dimensional parameters of the parts of the pulsating device.

SUMMARY

The following embodiments and aspects thereof are described and illustrated in conjunction with systems, tools and methods which are meant to be exemplary and illustrative, not limiting in scope.

In an aspect of the present invention there is provided a an embodiment of a rotating sprinkler for use with a pulsating device, the pulsating device being adapted to form liquid pulses and each liquid pulse has a beginning when the pulse begins and an end when the pulse ends, the sprinkler comprising a rotating portion adapted to move in rotation about an axis, and adapted to emit the liquid pulses to the outside environment, wherein the rotating portion is adapted to stop to rotate before the end of each liquid pulse.

Preferably, before the end of each pulse that is emitted the rotating sprinkler will always stop to rotate. And also preferably, after stopping to rotate before an end of a given pulse; the sprinkler will not continue to rotate due to a momentum force applied upon the rotating portion by the remainder of the given pulse that is still being emitted until the given pulse ends. Optionally, a terminal rotational movement may in some cases occur after an end of a pulse due to biasing forces applied in the sprinkler upon elements of the rotating portion.

Typically, the stopping of rotation of the rotating portion will occur after optionally at most 85% of a pulse time Tp has passed, and preferably after at most 75% of a pulse time Tp has passed, with the pulse time being a time measured between a beginning and an end of a pulse.

Typically the rotating portion is adapted to start to rotate at or after the beginning of each liquid pulse.

Preferably, the rotation of the rotating portion is urged by the pulses emitted to the outside environment. If desired, pulses emitted by the rotating portion to the outside environment are directed along paths forming a moment force that urges the rotation of the rotating portion. Possibly, the rotation of the rotating portion is formed by this moment force at least until the rotating portion stops to rotate before the pulse ends. Alternatively or in addition, the rotation of the rotating portion is formed by the pulses emitted to the outside environment urging movement of at least some parts of the rotating portion that bear against each other and/or against static parts or portions of the sprinkler to mechanically urge rotation.

Optionally, the liquid pulses also urge the rotating portion to move along the axis and possibly this movement assists the aforementioned mechanical urging of rotation.

If desired, before or when starting to rotate the rotating portion moves up along the axis and after stopping to rotate the rotating portion moves down along the axis. Possibly, such upward movement urges at least a part of the rotating portion to bear against a slanted surface of e.g. the sprinkler and slide along said slanted surface to assist and/or cause rotation of the sprinkler's rotating portion. Possibly, in a rotating portion in which such sliding causes rotation—pulses emitted to the outside environment may be directed along paths that substantially form small or no moment force about the axis of rotation of the rotating portion.

Optionally, the sprinkler comprises a biasing means adapted to urge the rotating portion to move down along the axis.

Typically, the sprinkler also comprises a static portion, and wherein movement of the rotating portion is controlled by interaction between the rotating and static portions. Possibly, the static portion comprises the slanted surface assisting and/or causing rotation.

Further typically, the interaction comprises stopping movement of the rotating portion by the static portion. This stopping may be performed after parts of the rotating performed rotational and/or axial relative movements possibly including the sliding interaction for urging the rotation.

Optionally, the rotating sprinkler comprises first and second members, the first member being fixed to move together with the rotating portion, and the second member not being fixed to move together with the rotating portion along at least one of the rotational or axial direction.

Further optionally, the rotation of the rotating portion during emission of a liquid pulse includes the second member trailing the first member along at least one of the axial or rotational directions.

If desired, an angular rotational movement of the rotating portion between beginnings of subsequent pulses is "theta", and wherein 360° divided by "theta" is equal to an integer. Such a "theta" will result in a sprinkler repeating angular movements in subsequent revolutions about axis X (i.e. stopping for example substantially at the same locations in subsequent revolutions).

If desired, an angular rotational movement of the rotating portion between beginnings of subsequent pulses is "theta", and wherein 360° divided by "theta" is not equal to an integer. Such a "theta" will result in a sprinkler that does not repeat the same angular movements in subsequent revolutions about axis X (i.e. does not for example stop at the same locations in subsequent revolutions). This will result in a more arbitrary and even distribution of the liquid pulses to an area of a field being irrigated. Preferably, in some embodiments, such a non-integer deriving angle "theta" is similar for all pulses being emitted—and this may be provided by such embodiments being formed with a mechanically "controlled" angular step-wise movement that repeats itself during each pulse. Such a mechanically "controlled" arrangement may be embodied by e.g. pins or teeth moving within e.g. grooves or passages or any other meshing, mechanical arrangement.

In accordance with an aspect of the present invention there is also provided a rotating sprinkler for use with a pulsating device, the pulsating device being adapted to form liquid pulses and each liquid pulse has a beginning when the pulse begins and an end when the pulse ends, the sprinkler comprising a rotating portion adapted to move in rotation about an axis, and adapted to emit the liquid pulses to the outside environment, wherein an angular rotational movement of the rotating portion between beginnings of subsequent pulses is "theta", and wherein 360° divided by "theta" is not equal to an integer. Embodiments including such an angle "theta" that results in 360° divided by "theta" not being equal to an integer, distribution of liquid to the outside environment may be more arbitrary and non repetitive. Thus such embodiments improve distribution of liquid over an area to be irrigated.

In an embodiment, such an angle "theta" that results in 360° divided by "theta" not being equal to an integer is accomplished by providing the sprinkler with first and second members, the first member being fixed to move together with the rotating portion, and the second member not being fixed to move together with the rotating portion along at least one of the rotational or axial direction. Possibly, the rotation of the rotating portion during emission of a liquid pulse includes the second member trailing the first member along at least one of the axial or rotational directions.

In accordance with an aspect of the present invention there is also provided a method of irrigation that comprises: providing a pulsating device forming liquid pulses that each have a beginning when the pulse begins and an end when the pulse ends, providing a sprinkler comprising a rotating portion adapted to move in rotation about an axis, urging the pulses formed by the pulsating device to be emitted to the outside environment via the sprinkler, wherein the rotating portion is adapted to stop to rotate before the end of each liquid pulse.

Typically, the rotating portion is adapted to start to rotate at or after the beginning of each liquid pulse.

Preferably, the rotation of the rotating portion is urged by the pulses emitted to the outside environment.

If desired, the liquid pulses also urge the rotating portion to move along the axis.

Optionally, before or when starting to rotate the rotating portion moves up along the axis and after stopping to rotate the rotating portion moves down along the axis.

Further optionally, the sprinkler further comprises a biasing means adapted to urge the rotating portion to move down along the axis.

Typically, the sprinkler comprises also a static portion, and wherein movement of the rotating portion is controlled by interaction between the rotating and static portions.

Optionally, the interaction comprises stopping movement of the rotating portion by the static portion.

If desired, the sprinkler comprises first and second members, the first member being fixed to move together with the rotating portion, and the second member not being fixed to move together with the rotating portion along at least one of the rotational or axial direction.

Optionally, the rotation of the rotating portion during emission of a liquid pulse includes the second member trailing the first member along at least one of the axial or rotational directions.

Optionally, the rotating portion is adapted to stop to rotate only once before the end of each liquid pulse.

If desired, an angular rotational movement of the rotating portion between beginnings of subsequent pulses is "theta", and wherein 360° divided by "theta" is equal to an integer.

If desired, an angular rotational movement of the rotating portion between beginnings of subsequent pulses is "theta", and wherein 360° divided by "theta" is not equal to an integer.

A further aspect of the present invention may be seen as relating to a rotating sprinkler that has a rotating portion which is adapted to rotate in equally spaced angular rotational movements (steps) of angle "theta" about a rotational axis. In certain embodiments 360° divided by "theta" may be equal to an integer and in other embodiments 360° divided by "theta" may be not-equal to an integer. The rotating portion may be movable along its rotational axis between a lower retracted position and an upper ejected position, and each step "theta" may start at a retracted position and end at a subsequent retracted position while in between passing via an ejected position. Preferably, after ending a step if not lifted back up from a retracted position towards an ejected position the rotating portion stops to rotate about the axis or can not perform an additional subsequent step about the axis until it is lifted. In embodiments where 360° divided by "theta" is not-equal to an integer the sprinkler does not repeat e.g. stopping locations of its steps in subsequent revolutions about its axis and thus provides a more arbitrary and even distribution of irrigated liquid to an area of a field. Urging of the rotating portion up from the retracted position may be by liquid pressure supplied downstream to the sprinkler from a liquid source upstream. The liquid flowing via the sprinkler and then emitted to the outside environment to irrigate may assist at least in part to the rotation of the sprinkler and for performing the steps "theta".

In a broad aspect, embodiments of the present invention's sprinkler include at least two (or preferably two) members that are involved in controlling/assisting step wise movement about the sprinkler's axis of rotation in order to achieve an angle "theta" that derives a non-integer when dividing 360° by "theta". The at least two (or preferably two) members provide each a part of the angle "theta" that when added provide the non-integer deriving "theta". Since embodiments of the sprinkle of the present invention continuously revolve about their axis splitting the rotational step into increments by the members has been found to be a simple and practical manner of achieving a non-integer deriving "theta".

In addition to the exemplary aspects and embodiments described above, further aspects and embodiments will become apparent by reference to the figures and by study of the following detailed descriptions.

BRIEF DESCRIPTION OF THE FIGURES

Exemplary embodiments are illustrated in referenced figures. It is intended that the embodiments and figures disclosed herein are to be considered illustrative, rather than restrictive. The invention, however, both as to organization and method of operation, together with objects, features, and advantages thereof, may best be understood by reference to the following detailed description when read with the accompanying figures, in which.

Figure 1:
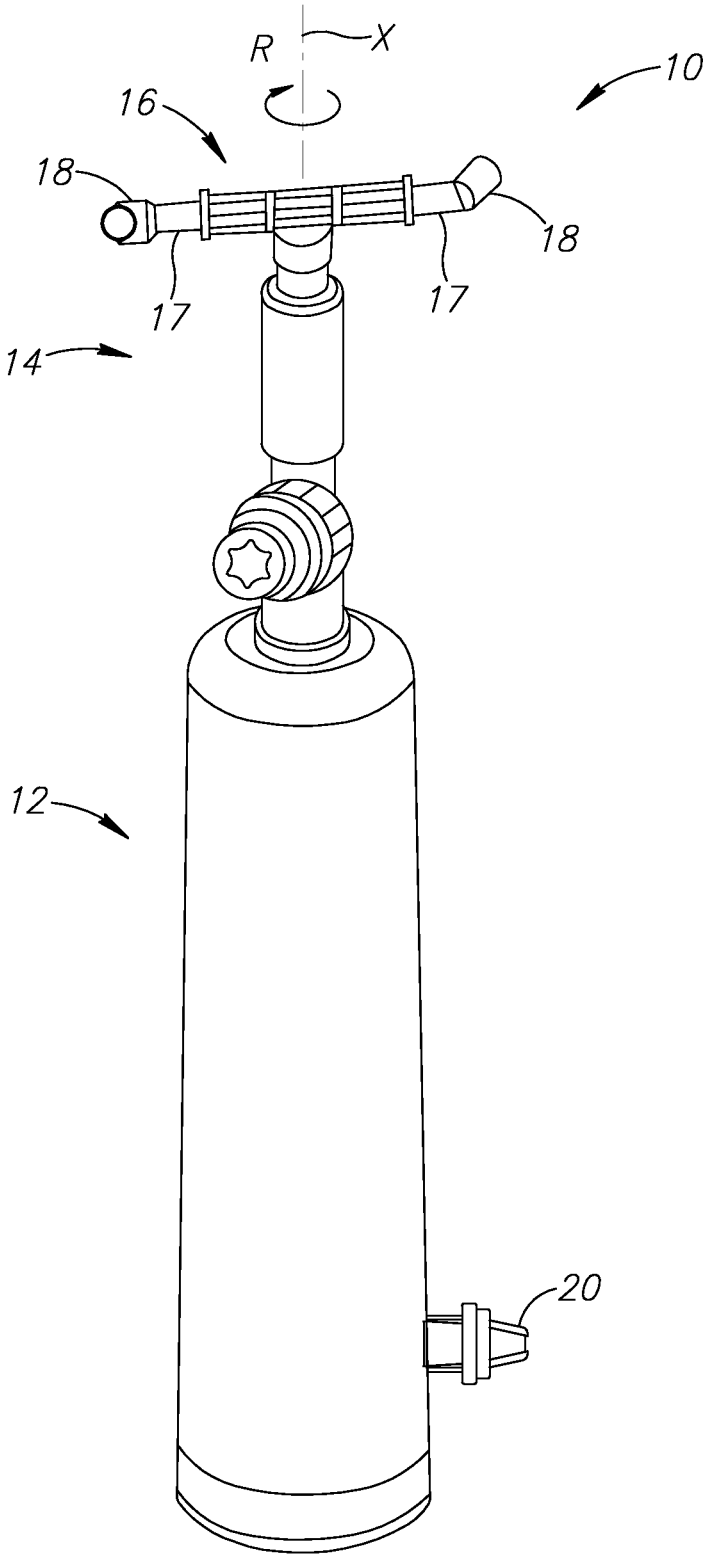
FIG. 1 schematically shows a perspective top view of an irrigation assembly including a pulsating device and a rotating sprinkler in accordance with various embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated within the figures to indicate like elements.

DETAILED DESCRIPTION

Attention is first drawn to FIG. 1 showing an irrigation assembly 10 that includes a pulsating device 12 that is adapted to transform an incoming liquid flow from a liquid source upstream (not shown) to intermittent outgoing liquid pulses that are ejected from device 12 downstream. The liquid may be water that may contain substances used in agricultural applications in which the irrigation assembly is used such as plant nutrients, pesticides and/or medications; and the liquid source upstream may optionally be a pipe such as an irrigation pipe.

Irrigation assembly 10 has an axis of rotation X and an inlet 20 for leading liquid into device 12 from the upstream pressurized liquid source. In addition, irrigation assembly 10 has a rotating sprinkler 14 in accordance with the various embodiments of the present invention. Materials from which the parts forming the various embodiments of sprinkler 14 may be made of include: acetal, nylon, PBT, reinforced polypropylene (etc.). Parts aimed at providing friction such as the frictional pads that will be described herein may be made of also other materials that appropriately increase friction such as rubber or combinations of rubber with plastics or polymers. Sprinkler 14 shown and described herein receives the liquid pulses ejected from device 12, and has a rotating portion 16 that is adapted to rotate about axis X in a rotational direction R. The rotating portion includes two arms 17 and two nozzles 18 attached each to an end of a respective arm 17, and nozzles 18 are adapted to discharge the liquid pulses received from device 12 to the outside environment along directions that form moments of force that urge the rotating portion to rotate in direction R about axis X. It is to be understood that sprinkler 14 may include any number of nozzles 18 (and respective arms 17) such as one or more than two.

It is noted that directional terms appearing throughout the specification and claims, e.g. "forward", "rear", "up", "down" etc., (and derivatives thereof) are for illustrative purposes only, and are not intended to limit the scope of the appended claims. Also it is noted that the directional terms "down", "below" and "lower" (and derivatives thereof) all define identical directions. Finally it is noted that leading and trailing directions used herein correspond respectively the rotational direction R and a direction that opposes direction R about axis X.

When irrigation starts, liquid entering the pulsating device via inlet 20 increases the pressure within device 12 until it reaches a first threshold pressure Po which is the pressure at which device 12 begins releasing a pulse of liquid towards sprinkler 14 that in turn discharges the pulse to the outside environment via its nozzles. As liquid exits the pulsating device, the pressure within device 12 drops and the pulse continues to exit device 12 until the pressure within the device reaches a second threshold pressure Pc at which the pulse ends. A pulse time Tp is defined as the time that passes between a beginning and an end of a pulse.

As long as the pulsating device remains in liquid communication with the pressurized liquid source upstream, the termination of a given pulse will be followed by a subsequent rise of pressure within device 12 which will lead to a subsequent pulse that is released from the pulsating device to the outside environment via sprinkler 14 until the pressure drops again and the subsequent pulse ends (and so on).

Figure 2B:
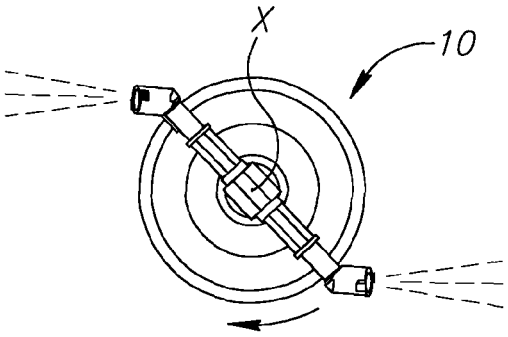
FIGS. 2A to 2F schematically show top views of the irrigation assembly of FIG. 1 during different stages of irrigation.
Figure 2A:
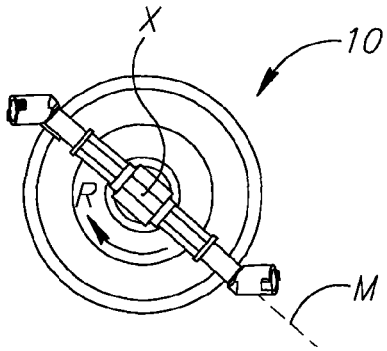

Attention is now drawn to FIGS. 2A to 2F. In accordance with the various embodiments of the present invention, sprinkler 14 is at a stand still position with no substantial rotation about axis X, at times such as in between liquid pulses (i.e. after the pressure in device 12 fell to below threshold Pc and before rising back to reach threshold Po); or before starting an irrigation sequence that includes exposing system 10 to communication with pressure from the liquid source upstream. An example of such a stand still position of sprinkler 14 is shown in FIG. 2A, and at this position the orientation of the rotating portion of sprinkler 14 about axis X can be defined by an axis M. Axis M that perpendicularly intersect axis X, is shown in this example to extend optionally along one of the arms of the rotating portion. However since the purpose of this axis (as will be apparent herein below) is to indicate the relative rotational movement that sprinkler 14 performs during each liquid pulse, the exact parts along which axis M may extend are not critical as long as this axis is considered to be fixed to rotate together with the rotating portion of sprinkler 14 while perpendicularly intersecting axis X.

As the pressure within device 12 rises and reaches Po, a liquid pulse begins to exit device 12 towards sprinkler 14 at a maximal momentum. The pulse at this maximal momentum starts its discharge to the outside environment via the nozzles of sprinkler 14, while also urging sprinkler 14 to assume a maximal acceleration about axis X (FIG. 2B).

Figure 2C:
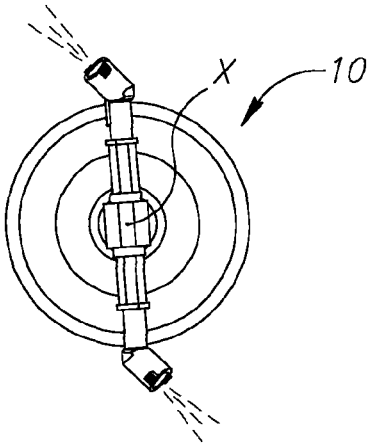
Figure 2D:
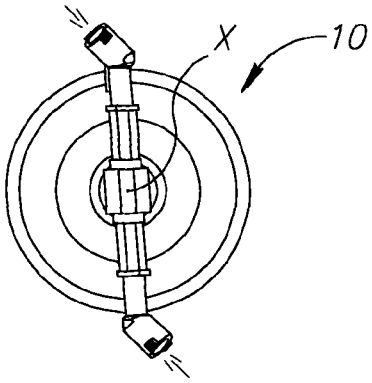

Sprinkler 14 will rotate a certain angle about axis X until the sprinkler will stop its rotation before the pulse has reached its end (FIG. 2C). The stopping of rotation of the rotating portion of sprinkler 14 will occur after optionally at most 85% of the pulse time Tp has passed, and preferably after at most 75% of the pulse time Tp has passed. After stopping to rotate, liquid still at a substantial momentum will continue to exit sprinkler 14 for the remainder of the pulse time Tp while the sprinkler stands still (FIG. 2D) until the pulse ends and thus terminates the stream of liquid that is being sprayed via the nozzles (FIG. 2E). A subsequent pulse that will begin to exit device 12 will urge sprinkler 14 to perform a further rotational step about axis X and, while although not shown, this rotational step will be substantially similar to that described with reference to FIGS. 2B to 2E.

The stopping of the rotation of sprinkler 14 about axis X while a given liquid pulse is still being discharged from sprinkler 14 generally increases the distance that the liquid being sprayed from sprinkler 14 can reach. The liquid being sprayed while sprinkler 14 rapidly rotates about axis X at the beginning of each pulse, which due to the rapid rotation is sprayed to a shorter distance, together with the larger distance that is obtained when sprinkler 14 stops to rotate imparts to the sprinkler in accordance with the various embodiments of the present invention a relatively even distributed spraying pattern that can cover an area spanning from relatively close to sprinkler 14 (when in rotation) to relative far from the sprinkler (when standing still). By way of a non binding example, a sprinkler 14 being "fed" from device 12 with liquid pulses having a first threshold pressure Po of about 2 and possibly up to about 2.5 atmospheres and a second threshold pressure Pc of about 1 and possibly up to about 1.2 atmosphere, can spray liquid downstream to distances of up to a radius of about 11 and possibly up to about 13 meters when static, and to distances of up to a radius of about 6 meters when rotating rapidly about axis X such as at the beginning of each pulse.

Figure 2F:
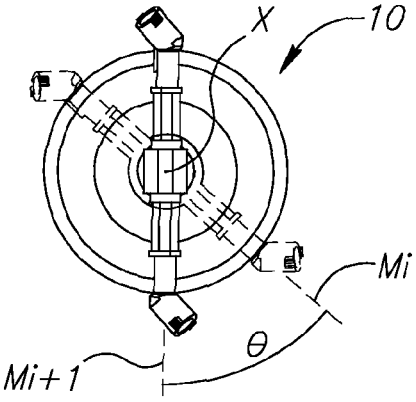
Figure 2E:
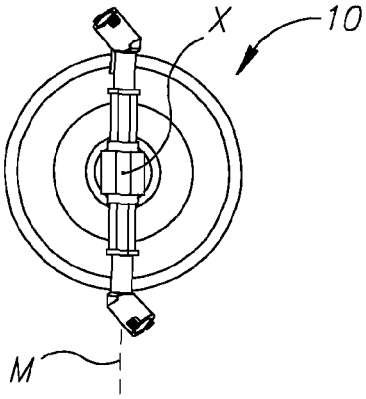

FIG. 2F is a superposition of FIGS. 2A and 2E placed one over the other that shows the rotational position of sprinkler 14 just before a beginning of a pulse and just before a beginning of a subsequent pulse. In FIG. 2F, the arms and nozzles imported from FIG. 2A are displayed using dashed lines, and the axes M imported from FIGS. 2A and 2E are respectively indicated as $M_i$ and $M_{i+1}$. By way of generalization, the letter 'M' followed by index 'i' symbolizes the final rotational position that sprinkler 14 obtained after pulse 'i', and the letter 'M' followed by index 'i+1' symbolizes the final rotational position that sprinkler 14 obtained after a subsequent pulse 'i+1'. Finally, angle "theta" between axes $M_i$ and $M_{i+1}$ indicates the angular rotational movement or step that sprinkler 14 performed during a given pulse 'i+1' (i.e. "theta" is an angle measured between a position just before a beginning of a pulse and a position just before a beginning of a subsequent pulse).

Figure 3:
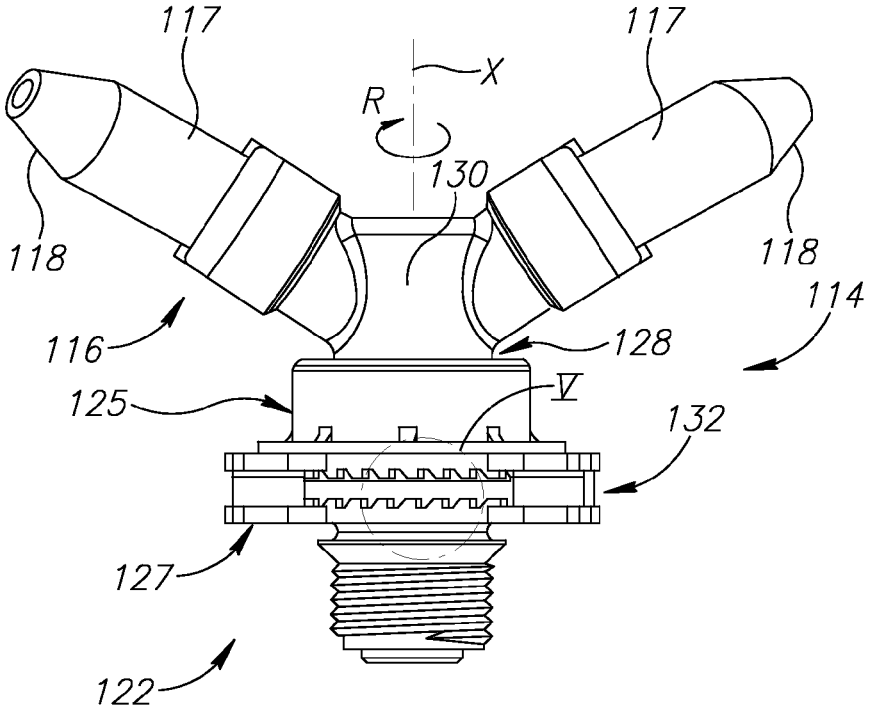
FIG. 3 schematically shows a side view of a first embodiment of a rotating sprinkler in accordance with the present invention.
Figure 4:
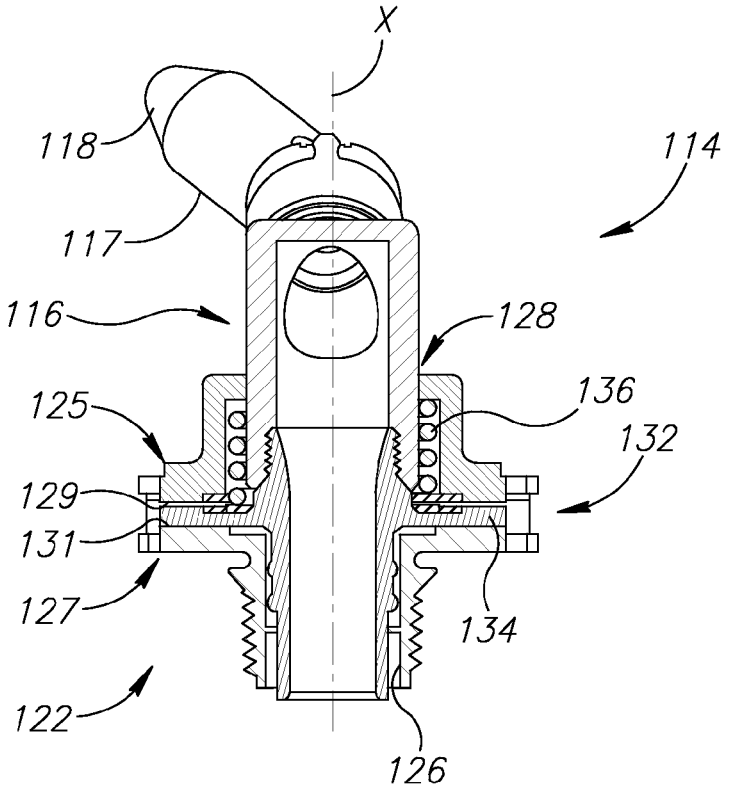
FIG. 4 schematically shows a cross sectional view of the rotating sprinkler of FIG. 3.

Attention is now drawn to FIGS. 3 and 4. In an embodiment of the present invention, irrigation assembly 10 includes a rotating sprinkler 114 in accordance with a first embodiment of the present invention. Sprinkler 114 has a static portion 122 and a rotating portion 116 that is adapted to rotate in direction R about axis X of the assembly. Static portion 122 is in the form of a housing that encloses a volume 126, and volume 126 opens out of portion 122 at an upper and a lower end of portion 122. The rotating portion of sprinkler 114 includes a stem 128 with a generally cylindrical hollow body. Stem 128 extends through volume 126 and protrudes upwards out of static portion 122 towards a merge 130 of the rotating portion. From merge 130, two arms 117 of rotating portion 116 extend in directions away from axis X to respective nozzles 118 of the rotating portion.

Static portion 122 includes a peripheral slit 132 that extends about axis X and communicates between volume 126 and the environment outside of portion 122. Slit 132 divides portion 122 into upper and lower parts 125, 127 which are kept spaced apart at slit 132 by spacers (not indicated). Upper part 125 includes a downwardly facing roof 129 located above slit 132 and lower part 127 includes an upwardly facing floor 131 located below slit 132. Stem 128 also includes a peripheral rotor 134 that extends about axis X and in a radial outward direction away from axis X and from its body. Rotor 134 is located within slit 132, and sprinkler 114 includes a compression spring 136 that is pressed between the upper part of static portion 122 and rotor 134. Spring 136 as a result exerts a downwardly directed force that can urge the rotating portion of sprinkler 114 downwards.

Sprinkler 114 is adapted to be fitted to the pulsating device of assembly 10 at a lower end of static portion 122, and pulses emitted from device 12 are adapted to flow upwards via the stem and arms of the rotating portion of sprinkler 114 to be emitted to the outside environment via the nozzles of sprinkler 114. These liquid pulses can urge the rotating portion of sprinkler 114 to rotate in direction R about axis X and also apply an upwardly directed force that can urge the rotating portion of sprinkler 114 to lift upwards against the downwardly directed biasing force of spring 136.

Figure 5A:
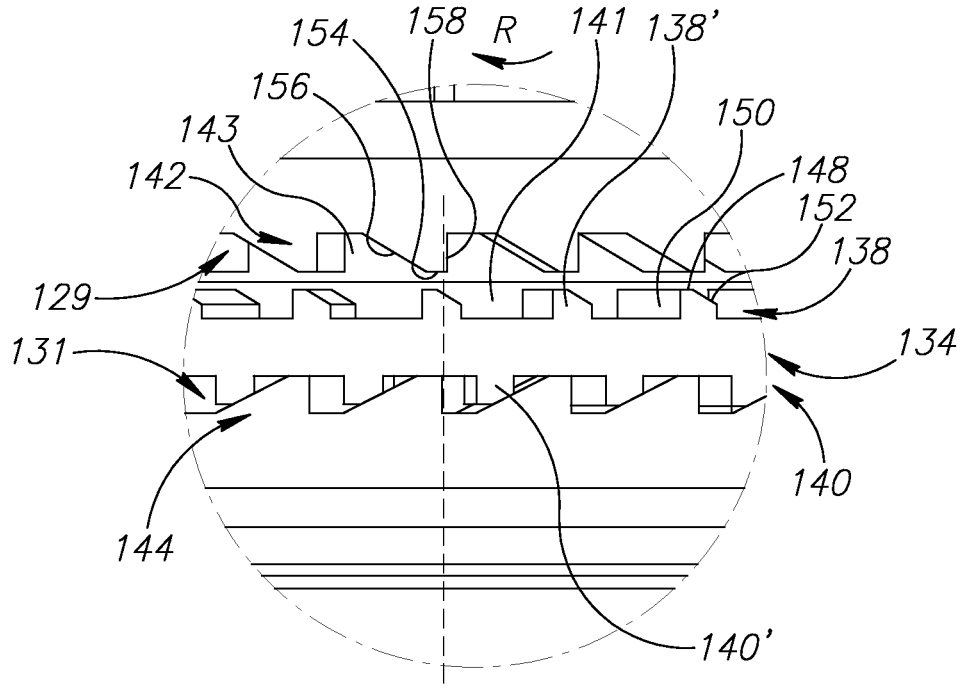
FIGS. 5A and 5B schematically show a section of the rotating sprinkler of FIG. 3 and positions this rotating sprinkler may assume during irrigation.
Figure 5B:
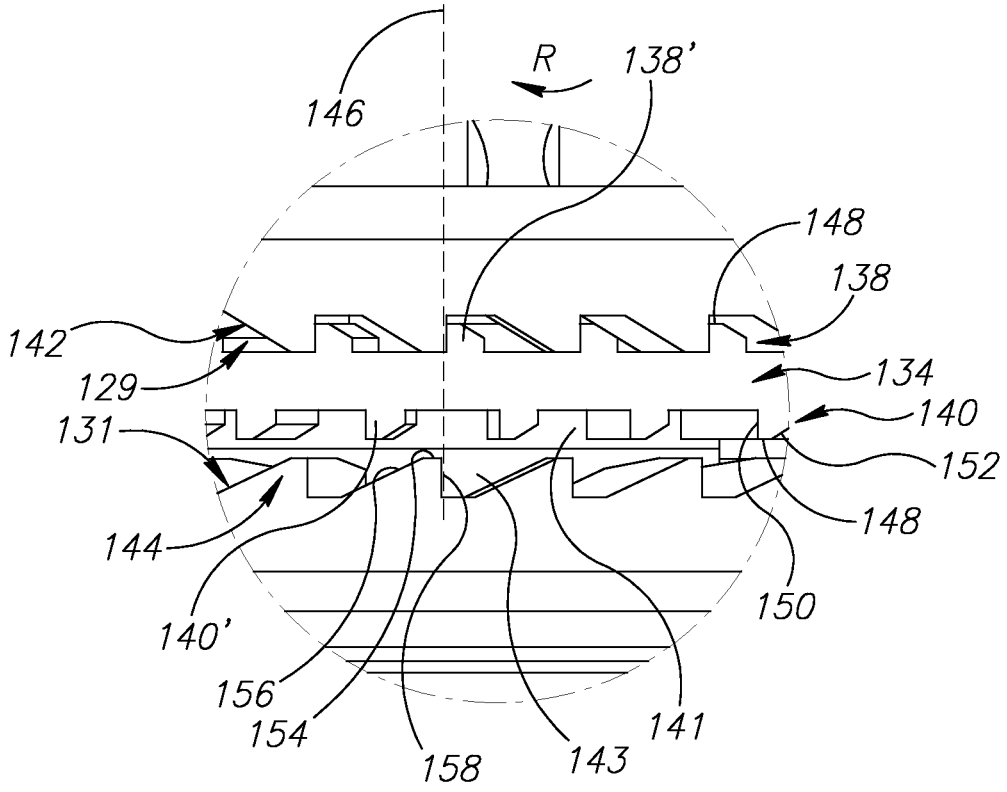

Attention is now additionally drawn to FIGS. 5A and 5B showing upper and lower sets of rotor teeth 138, 140 that are formed on respective upper and lower sides of a disk shaped core of rotor 134. Each rotor tooth in sets 138 and 140 is spaced apart by valley 141 from an adjacent rotor tooth in its respective set, and includes a head 148 and leading and trailing walls 150, 152. Leading wall 150 may be generally perpendicular to the core of rotor 134 and trailing wall 152 slants in a trailing direction from head 148 towards the core of rotor 134.

Also FIGS. 5A and 5B show that both roof 129 and floor 131 are formed with sets of stator teeth 142, 144 that project into slit 132. Each stator tooth in sets 142 and 144 is spaced apart by basin 143 from an adjacent stator tooth in its respective set, and includes a top 154 and leading and trailing faces 156, 158. Leading face 156 slants in a leading direction from top 154 towards its respective roof 129 or floor 131, and trailing face 158 may be generally perpendicular to its respective roof 129 or floor 131. Leading face 156 thus slants in a leading direction upwards towards roof 129 and downwards towards floor 131.

One of the upper rotor teeth in set 138 has been indicated as 138' and one of the lower rotor teeth in set 140 has been indicated as 140' so that the rotational position of rotor 134 (and thereby rotating portion 116) in between FIGS. 5A and 5B can be tracked. Also an imaginary plane indicated by dashed line 146 that extends along both these figures has been provided in order to assist in identifying similar stator teeth in sets 142 and 144 that remain static during the rotation of sprinkler 114.

The position of rotor 134 in FIG. 5A simulates the position of the rotating portion of sprinkler 114 in between liquid pulses or before starting an irrigation sequence that includes exposing system 10 to communication with pressure from the liquid source upstream. In this position, spring 136 presses the rotating portion of sprinkler 114 downwards towards a retracted position so that lower set of rotor teeth 140 of rotor 134 is engaged with stator teeth in set 144 that are formed on floor 131. FIG. 2A that was previously discussed may be seen to represent the position of the rotating portion of sprinkler 114 as seen in FIG. 5A. Also as seen in FIG. 5A, rotor teeth 138' and 140' of rotor 134 are seen to the right of imaginary plane 146 with the slanted trailing wall 152 of tooth 140' overlaying and optionally abutting the slanted leading face 156 of a stator tooth in set 144 that is to the right of plane 146.

A liquid pulse beginning to exit device 12 at a pressure sufficient to apply a force that can overcome the force of spring 136, will urge rotor 134 to lift upwards towards an ejected position and remove its lower rotor teeth 140 from within the basins 143 of stator set 144. In addition, this liquid pulse when starting to be discharged to the outside environment via the nozzles of sprinkler 114 will also start to urge the rotating portion of sprinkler 114 to rotate about axis X (as already seen and discussed with respect also to FIG. 2B). The upper rotor teeth in set 138 of rotor 134 that lifted upwards will in turn enter the basins 143 of stator set 142 and as a result rotor 134 will be controlled to perform just a certain rotational movement or step in direction R about axis X before at least one of the leading walls 150 of the rotor teeth in set 138 will engage at least one of the trailing faces 158 of the stator teeth in set 142 as seen in FIG. 5B. FIG. 2C that was previously discussed may be seen to represent the position of the rotating portion of sprinkler 114 as seen in FIG. 5B. Also as seen in FIG. 5B, rotor tooth 140' of rotor 134 has moved to the left of imaginary plane 146 with its slanted trailing wall 152 now overlaying the slanted leading face 156 of a stator tooth in set 144 that is also to the left of plane 146.

The description of rotating sprinkler 114 will be paused at this point in order to note in this paragraph the following. It is noted that in some embodiments, the above discussed lifting of e.g. rotor 134 upwards by a liquid pulse may urge one or more of the slanted trailing walls 152 of the upper rotor teeth of set 138 to abut and bear against slanted leading face(s) 156 of stator set 142. Such abutting may result in such wall(s) 152 being urged to slide upon such face(s) 156 and by this "mechanical interaction" urge the rotating portion of the sprinkler to rotate about axis X in direction R. In the embodiment of e.g. sprinkler 11144 that is discussed herein below, ceilings 175 and 1175 may respectively be formed slanting upwards in a leading direction (and not as optionally displayed in FIGS. 12, 13) so that lifting by a liquid pulse of first and second members 11134*a*, 11134*a* may respectively urge "mechanical interaction" and sliding of teeth 186 and 188 upon ceilings 175, 1175 and by that rotation of sprinkler 11144 about axis X in direction R. Possibly, sprinklers in accordance with embodiments of the present invention where such "mechanical interaction" urges rotation may in some cases comprise nozzles (see, e.g. nozzles 18, 118, 1118, 11188 of embodiments disclosed herein) that extend in a direction that ejects liquid pulses substantially along axis M (see e.g. FIG. 2A) which in turn forms substantially "zero" moment of force about axis X. Such embodiments thus may possibly rely on "mechanical interaction" and substantially less (or not at all) on moment force for urging rotation of the rotating portion. Possibly, embodiments of the present invention may "enjoy" both "mechanical interaction" and moment of force for urging rotation in direction R about axis X by maintaining nozzles that extend in a direction for ejecting liquid pulses in a transverse and/or inclined direction relative to axis M (as seen e.g. in FIG. 2A).

Returning to the description of the rotating sprinkler 114 it is noted that the liquid pulse exiting device 12 will continue to flow via sprinkler 114 to be sprayed to the outside environment, while maintaining rotor 134 wedged and engaged in the stator teeth of set 142 (as also seen and discussed with respect to FIG. 2D) until the pulse ends and thus terminates the stream of liquid being sprayed via the nozzles of sprinkler 114 (as seen also in FIG. 2E). The end of a given pulse will also terminate the upward directed force lifting the rotation portion of sprinkler 114 against the force of spring 136, thus allowing spring 136 to urge the rotating portion of sprinkler 114 back downwards. The position of the rotor (and thereby the rotating portion) of sprinkler 114 after moving back down at an end of a given pulse will be generally similar to that shown in FIG. 5A, but with rotor 134 being now rotated by a step about axis X in direction R (as apparent from the position of teeth 138' and 140' in FIG. 5B just before being moved downwards). That is to say that the tooth in set 140 that is to the right of tooth 140' will now move a step in direction R to assume the position of tooth 140'.

The rotational step that sprinkler 114 performs about axis X during a given liquid pulse may be finalized by a terminal rotational movement of the rotating portion of sprinkler 114 that is assisted by the downwardly biasing force of spring 136 that urges engagement between the slanted trailing wall 152 of lower rotor teeth 140 that engage and may slide slightly in direction R upon the slanted leading faces 156 of stator teeth 144. This terminal rotational movement may assist to more precisely urge the tooth in set 140 that is to the right of tooth 140' to assume the general position of tooth 140' seen in FIG. 5A.

A subsequent pulse will urge rotor 134 to lift back upwards and position rotor tooth 138' within the basin 143 (formed between two stator teeth of set 142) that is to the left of imaginary plane 146, so that sprinkler 114 will be able to advance a subsequent step about axis X in direction R. The number of teeth N in e.g. stator set 142 can be used to define the angular rotational movement or step "theta" that sprinkler 114 performs during a given pulse. Angle "theta" in sprinkler 114 is equal to 360°/N, and sprinkler 114 having such an angle "theta" will assume angular positions about axis X that will repeat themselves in subsequent revolutions about axis X. In a non binding example of a sprinkler 114 having N=45 stator teeth in e.g. set 142, the angular rotational movement or step "theta" is equal to 8°, which means that after each pulse sprinkler 114 advances an angle of 8° about axis A in direction R.

Figure 6:
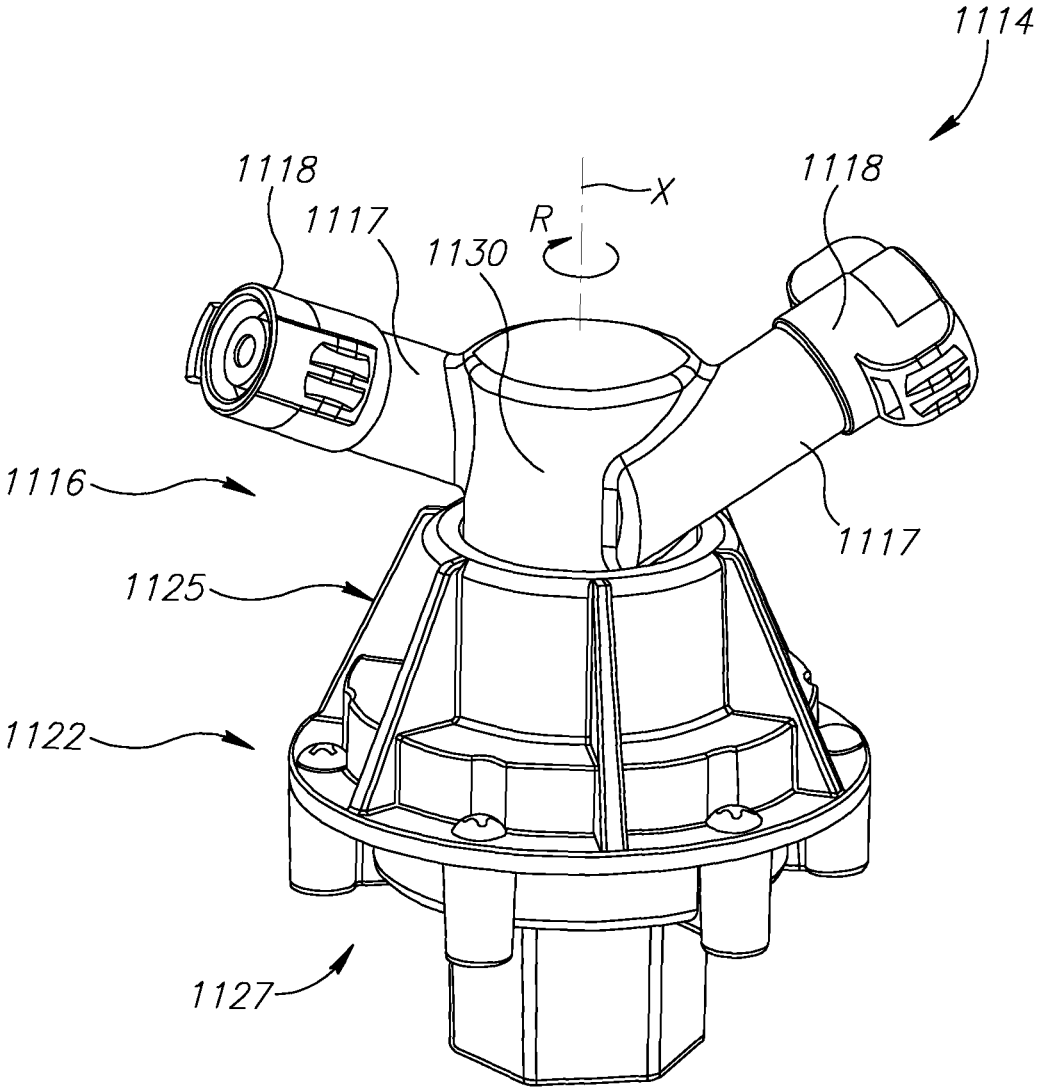
FIG. 6 shows a perspective top view of a second embodiment of a rotating sprinkler in accordance with the present invention.
Figure 7:
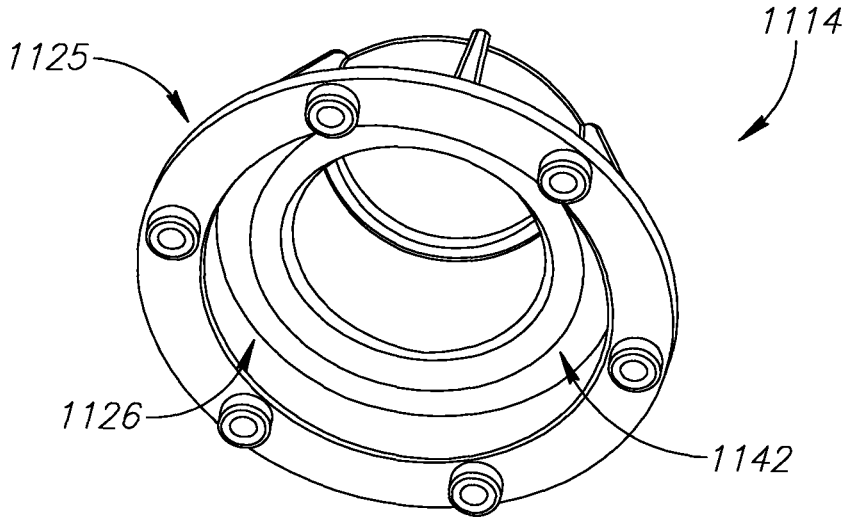
FIG. 7 shows the sprinkler of FIG. 6 with an upper part thereof removed to expose inner parts of the rotating sprinkler.
Figure 7:
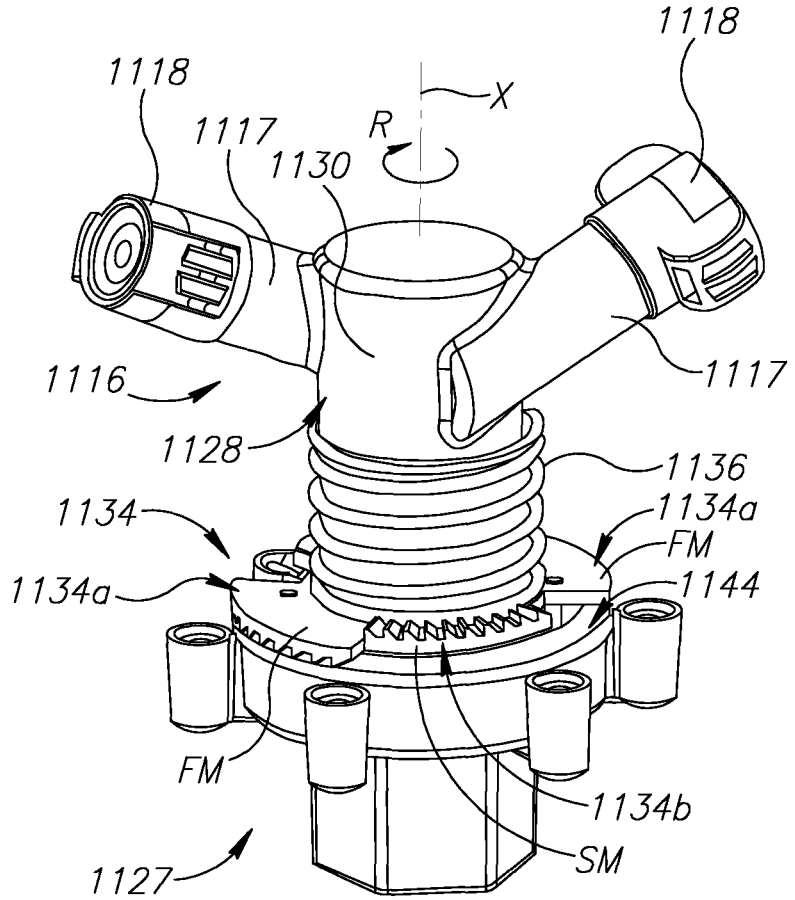

Attention is now drawn to FIGS. 6 and 7. In an embodiment of the present invention, irrigation assembly 10 includes a rotating sprinkler 1114 in accordance with a second embodiment of the present invention. Sprinkler 1114 has a static portion 1122 and a rotating portion 1116 that is adapted to rotate in direction R about axis X of the assembly. Static portion 1122 is in the form of a housing that encloses a volume 1126, and volume 1126 opens out of static portion 1122 at an upper and a lower end of static portion 1122. The rotating portion of sprinkler 1114 includes a stem 1128 with a generally cylindrical hollow body. Stem 1128 extends through volume 1126 and protrudes upwards out of static portion 1122 towards a merge 1130 of the rotating portion. From merge 1130, two arms 1117 of rotating portion 1116 extend in directions away from axis X to respective nozzles 1118 of the rotating portion.

Static portion 1122 has upper and lower parts 1125, 1127 with inner faces that surround volume 1126. And, a downwardly facing portion of the inner face of upper part 1125 includes a stator friction pad 1142 that are formed about axis X. Lower part 1127 has also a stator friction pad 1144 formed about axis X that opposingly faces stator friction pad 1142.

Stem 1128 includes a rotor 1134 formed of first and second members 1134*a*, 1134*b*. First member 1134*a* is fixed to rotate together with the rotating portion of sprinkler 1114 about axis X, and second member 1134*b* is pivotally fixed to rotating portion 1116 and thereby can perform rotational movements about axis X relative to the rotating portion of sprinkler 1114 and thereby also relative to first member 1134*a*. First and second members 1134*a*, 1134*b* however are fixed to translate together along axis X upwards and downwards.

Sprinkler 1114 includes a compression spring 1136 that is pressed between the upper part of static portion 1122 and rotor 1134 to thereby urge the rotating portion of sprinkler 1114 downwards. FIGS. 7 and 8A-8D show sprinkler 1114 with its upper part 1125 removed for the purpose of exposing inner parts of sprinkler 1114 that would otherwise be concealed. Although shown without upper part 1125 it is to be understood that spring 1136 in these figures is kept pressed from above by upper part 1125 that is accordingly not seen.

First member 1134*a* of rotor 1134 is formed of two identical ring shaped segments FM that are displaced by 180° one relative to the other about axis X. As a result, first member 1134*a* is also formed with two openings between these two segments FM that are also displaced by 180° the one relative to the other about axis X. Each such opening spans an angle "alpha" about axis X and in FIGS. 8A-8D a full span of only one of these openings is fully seen and indicated by the angle "alpha" (see FIG. 8C).

Each segment FM of member 1134*a* also includes a lower set downwardly projecting rotor teeth 1140 formed on it's a lower face. Each rotor tooth in set 1140 has an apex, a leading wall and a trailing wall. The leading wall of each tooth in set 1140 extends from the tooth's apex generally upwardly to perpendicularly meet the lower face of its member 1134*a*, and the trailing wall of each tooth in set 1140 slants in a trailing and upward direction from the tooth's apex to the lower face of its member 1134*a*.

Second member 1134*b* of rotor 1134 is also formed of two identical ring shaped segments SM that are displaced by 180° one relative to the other about axis X (one of the segments SM is not seen in FIG. 7 since it is hidden behind stem 1128). Each segment SM of second member 1134*b* spans an angle "beta" about axis X (see angle "beta" indicated in FIG. 8C) and each segment SM includes a set upwardly projecting rotor teeth 1138 formed on its a upper face. Each rotor tooth in set 1138 has an apex, a leading wall and a trailing wall. The leading wall of each tooth in set 1138 extends from the tooth's apex generally downwardly to perpendicularly meet the upper face of its member 1134*b*, and the trailing wall of each tooth in set 1138 slants in a trailing and downward direction from the tooth's apex to the upper face of its member 1134*b*.

Attention is now drawn to FIGS. 8A-8D to discuss the operation of irrigation assembly 10 when exposed to a given liquid pulse that is discharged from device 12 via sprinkler 1114 to the outside environment. Similar to FIG. 7, in FIGS. 8A-8D also only one of the segments SM of second member 1134*b* is seen with the other segment SM being hidden behind stem 1128.

Figure 8A:
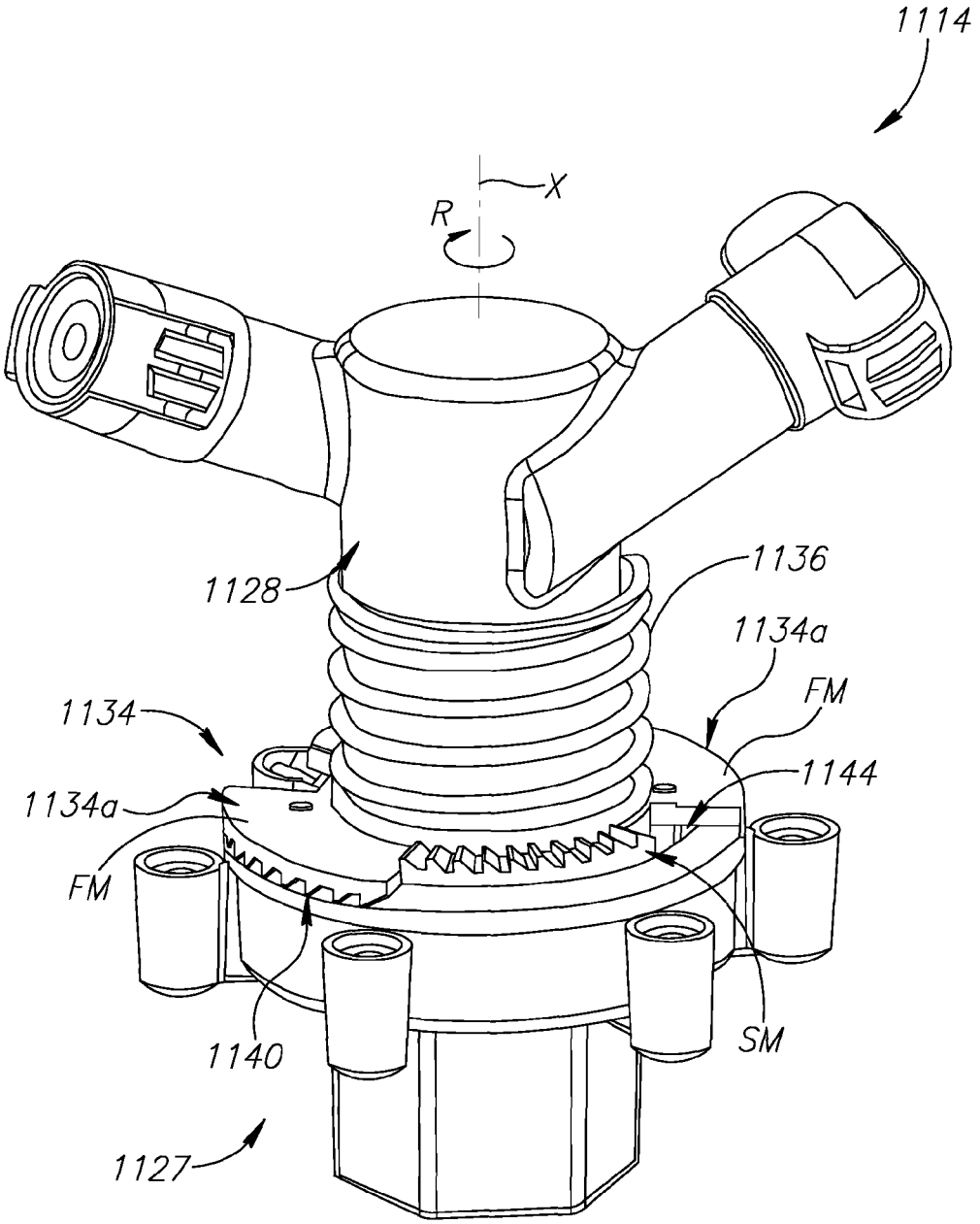
FIGS. 8A to 8D show the rotating sprinkler of FIG. 6 without the upper part and at some positions that this rotating sprinkler may assume during irrigation.

Attention is first drawn to FIG. 8A which is similar to FIG. 7 but with upper part 1125 not shown. This figure simulates the position of the rotating portion of sprinkler 1114 in between liquid pulses or before starting an irrigation sequence that includes exposing system 10 to communication with pressure from the liquid source upstream. In this position, spring 1136 presses the rotating portion of sprinkler 1114 downwards so that the lower sets of rotor teeth 1140 of each segment FM of rotor 1134 engage the stator friction pad 1144 that is formed on lower part 1127. Frictional engagement between the rotor teeth 1140 and friction pad 1144 ensures that the rotating portion sprinkler 1114 is maintained in a stand still position, and FIG. 2A that was previously discussed may be seen to represent the position of the rotating portion of sprinkler 1114 as seen in FIG. 8A.

Figure 8B:
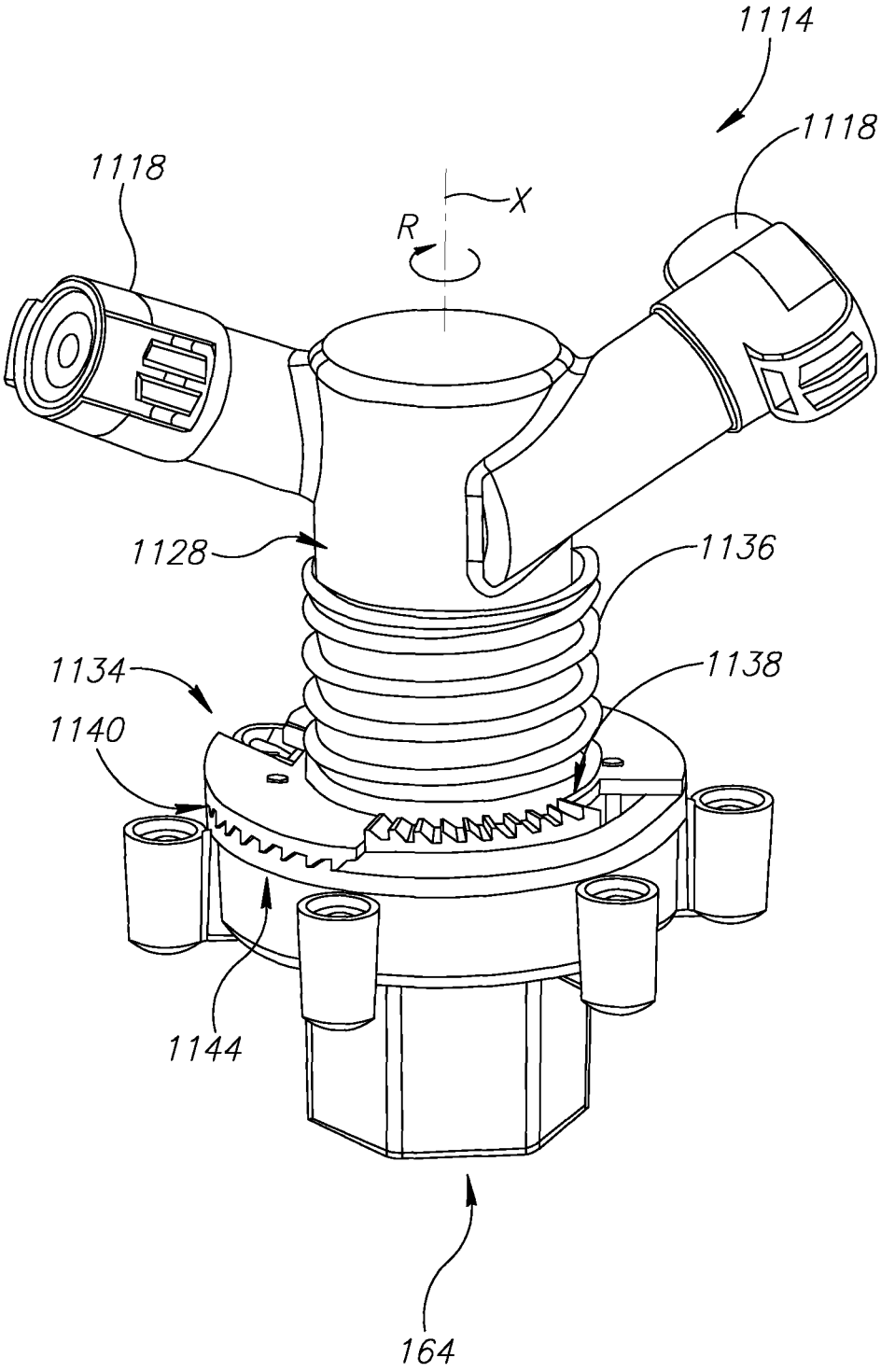

Attention is now drawn to FIG. 8B showing a liquid pulse indicated by wavy line 164 that begins to exit device 12 at a pressure sufficient to apply a force that can bear against the rotating portion of sprinkler 1114 and lift it up against the biasing force of spring 1136. The first and second members 1134*a*, 1134*b* that lift together with the rotating portion 1116 urge the lower rotor teeth 1140 of first member 1134*a* out of frictional engagement with the friction pad 1144, and the upper rotor teeth 1138 of the second member 1134*b* into frictional engagement with the friction pad 1142 of upper part 1125.

Since upper part 1125 is not shown in this figure, this frictional engagement between the rotor teeth 1138 and friction pad 1142 is not seen in FIG. 8B, however it is to be understood that due to this frictional engagement second member 1134*b* of rotor 1134 is kept "parked" so that it can not rotate about axis X. Depending on the design of sprinkler 1114, it may be that the first and second members 1134*a*, 1134*b* while lifting up will "slip" and perform a slight rotational movement about axis X before the frictional force caused by the rotor teeth of second member 1134*b* that engage friction pad 1142 will stop the rotation of rotating portion 1116.

Figure 8C:
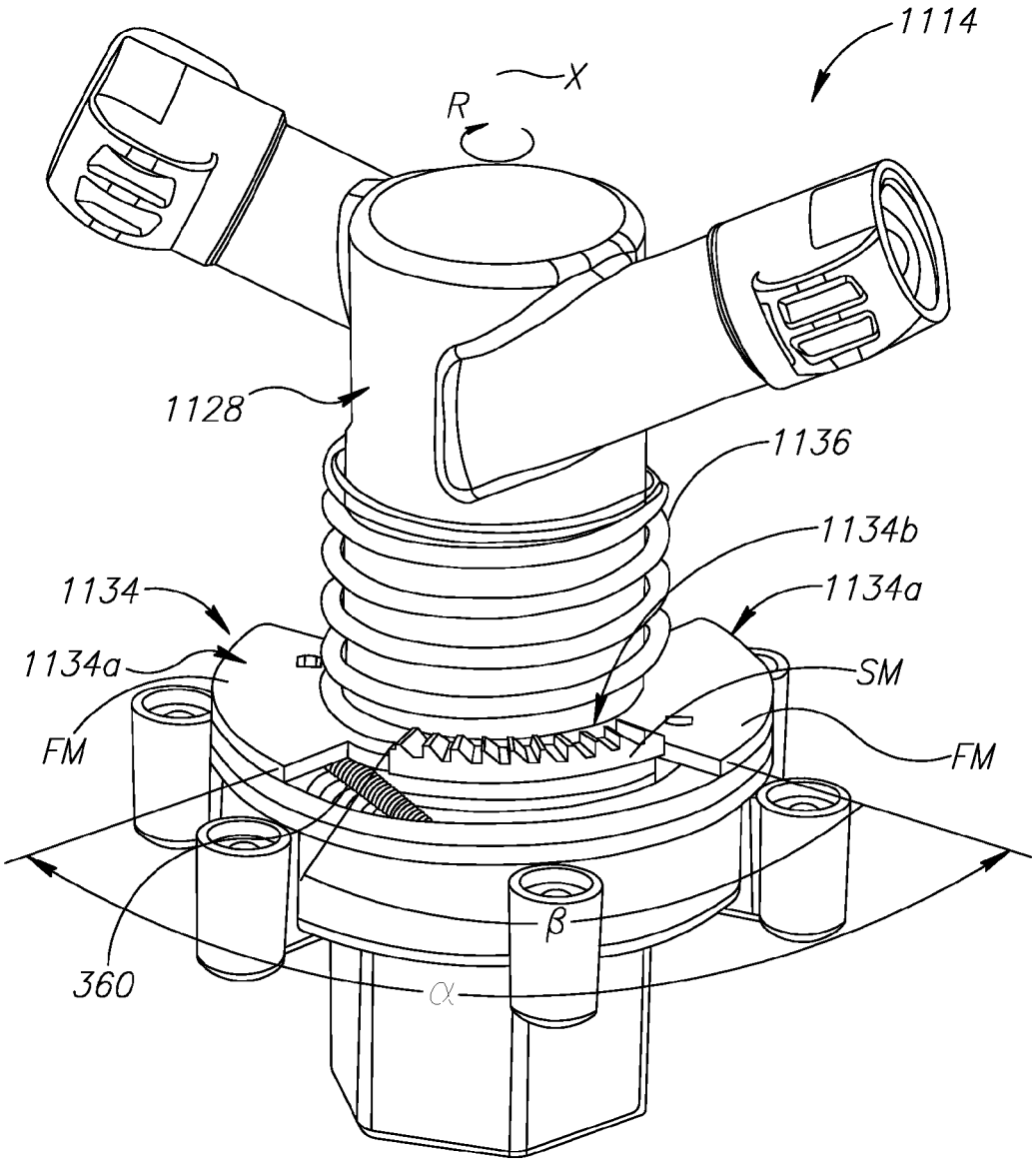

Attention is now drawn to FIG. 8C. The liquid pulse flowing through sprinkler 1114, when starting to be discharged to the outside environment via the nozzles of sprinkler 1114 will also start to urge the rotating portion of sprinkler 1114 to rotate about axis X (as already seen and discussed with respect also to FIG. 2B). The upper rotor teeth 1138 of second member 1134*b* that are kept engaged with friction pad 1142 (not shown) keep second member 1134*b* accordingly "parked" and not able to rotate about axis X. However, first member 1134*a* of rotor 1134 is able to rotate together with the rotating portion of sprinkler 1114 about axis X until a leading end of at least one of its segments FM abuts a trailing end of one of the segments SM of second member 1134*b*. FIG. 2C that was previously discussed may be seen to represent the position of the rotating portion of sprinkler 1114 as seen in FIG. 8C.

Still observing FIG. 8C it is seen that the rotating portion of sprinkler 1114 can rotate about axis X an angle equal to angle "alpha" minus angle "beta" until it is stopped. Also it is seen that the first and second members 1134*a*, 1134*b* in this embodiment are coupled together by a tension spring 360 that stretches when the first member 1134*a* rotates about axis X together with rotating portion 1116. Since here the liquid pulse that has not yet ended is still applying a moment force keeping first member 1134*a* in the position seen in FIG. 8C, the loaded force of spring 360 maintains a biasing force that acts to try and urge the still "parked" second member 1134*b* to rotate about axis X in direction R towards first member 1134*a*.

The liquid pulse exiting device 12 will continue to flow via sprinkler 1114 to be sprayed to the outside environment, while maintaining rotor 1134 at the stand still position seen in FIG. 8C (as also seen and discussed with respect to FIG. 2D) until the pulse ends and thus terminates the stream of liquid being sprayed via the nozzles of sprinkler 1114 (as seen also in FIG. 2E). The end of a given pulse will also terminate the upward directed force lifting the rotation portion of sprinkler 1114 against the force of spring 1136, thus allowing spring 1136 to urge the rotating portion of sprinkler 1114 back downwards.

Figure 8D:
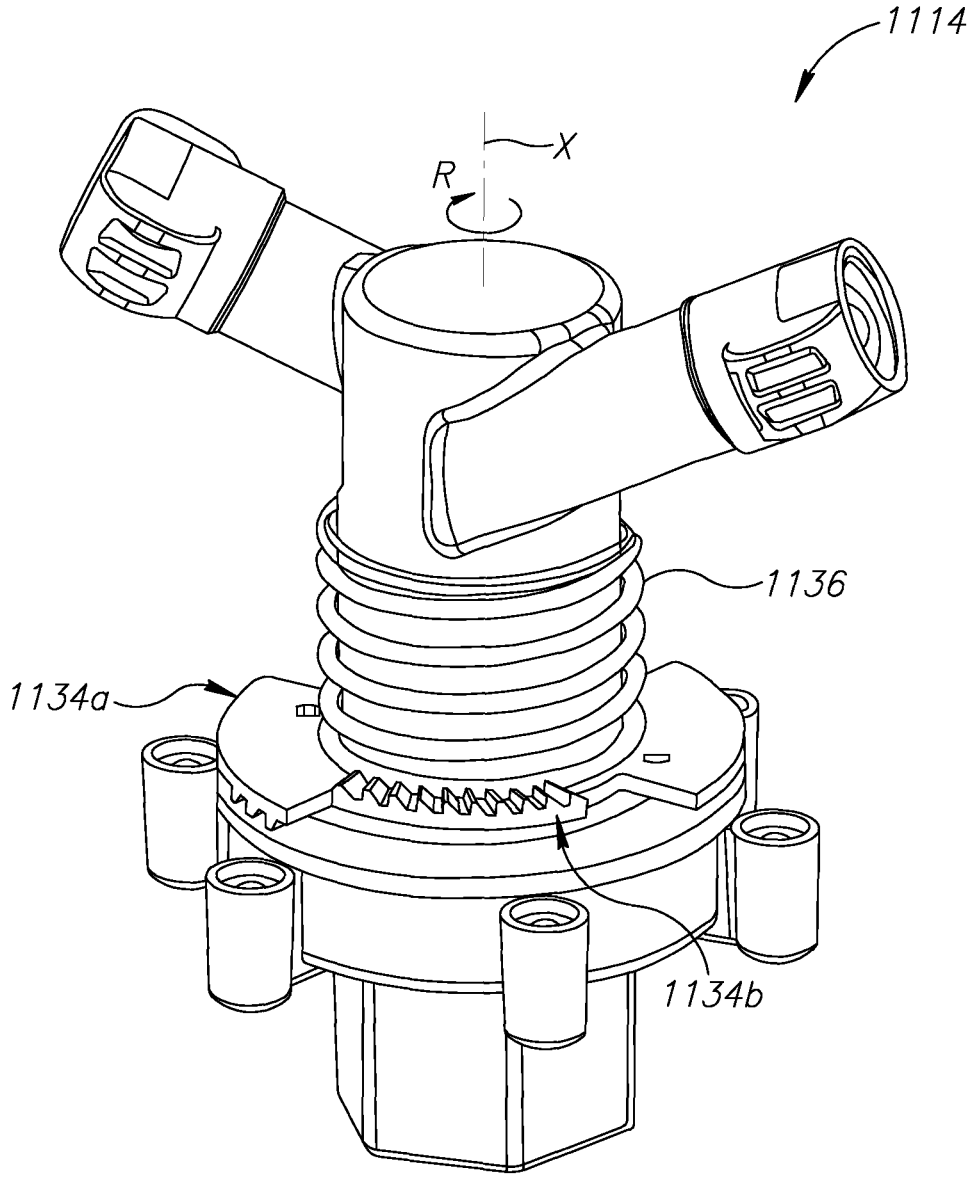

This downward movement of the rotating portion of sprinkler 1114 will urge the lower rotor teeth 1140 of first member 1134*a* to re-engage the friction pad 1144, while releasing the upper rotor teeth 1138 of second member 1134*b* from its "parked" engagement with the friction pad 1142 of upper part 1125. Once released from its "parked" state, loaded spring 360 can urge second member 1134*b* to trail first member 1134*a* by rotating about axis X in direction R until it meets first member 1134*a*. FIG. 8D shows a position of sprinkler 1114 during downward movement of its rotating portion 1116 and after second member 1134*b* of rotor 1134 has already been released from its "parked" state and rotated by spring 360 towards first member 1134*a*.

A subsequent pulse being emitted from device 12 will urge sprinkler 1114 to advance a subsequent step about axis X in direction R with the first and second members of rotor 1134 trailing each other as already described above. The angular rotational movement or step "theta" that sprinkler 1114 performs during a given pulse about axis X may be equal to "alpha" minus "beta". In cases (as discussed above) where sprinkler 1114 "slips" while its rotating portion moves up at the beginning of a pulse, angle "theta" may be equal to "alpha" minus "beta"+a random slight angular rotation of e.g. up to about 3°.

Angle "theta" of sprinkler 1114 may be seen to be equivalent to angle "theta" that has been previously discussed with respect to FIG. 2F. By choosing appropriate relations between parts in sprinkler 1114, angle "theta" may be defined to be an angle that derives an integer when 360° is divided by "theta". An embodiment of sprinkler 1114 with an angle "theta" that derives such an integer will assume angular positions about axis X that will substantially repeat themselves in subsequent revolutions about axis X.

However, if so desired sprinkler 1114 may be designed to have an angle "theta" that does not derive an integer when 360° is divided by "theta". Liquid pulses being "fed" to such an embodiment of sprinkler 1114 with an angle "theta" that does not derive an integer, will be sprayed to the outside environment along angular rotational movements or steps that do not repeat themselves in subsequent cycles (or revolutions) about axis X (i.e. do not for example repeat stopping at the same locations in subsequent revolutions). This will result in a more even and arbitrary distribution of sprayed liquid over an area of the field that is being irrigated.

Figure 9:
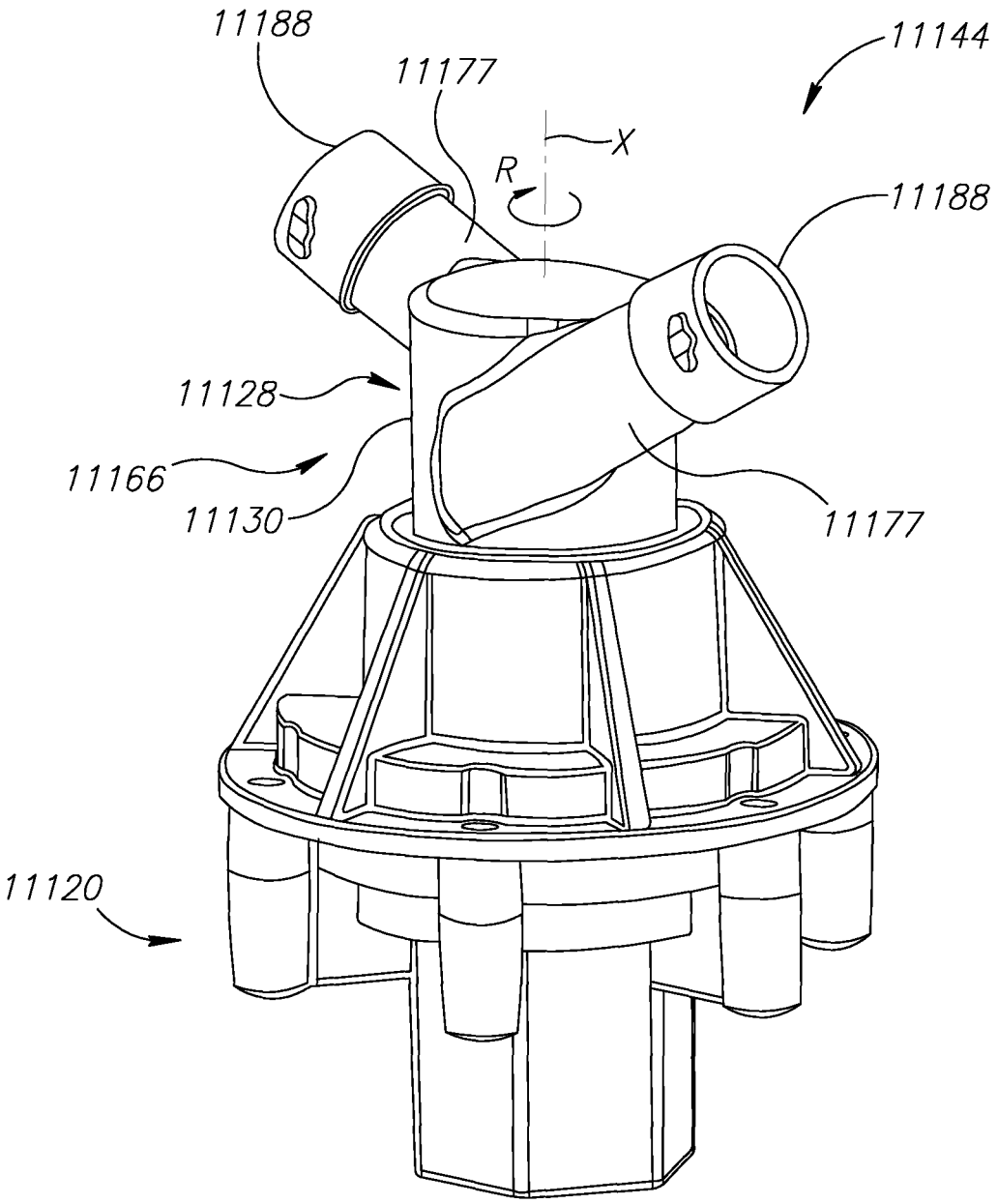
FIG. 9 shows a perspective top view of a third embodiment of a rotating sprinkler in accordance with the present invention.
Figure 10:
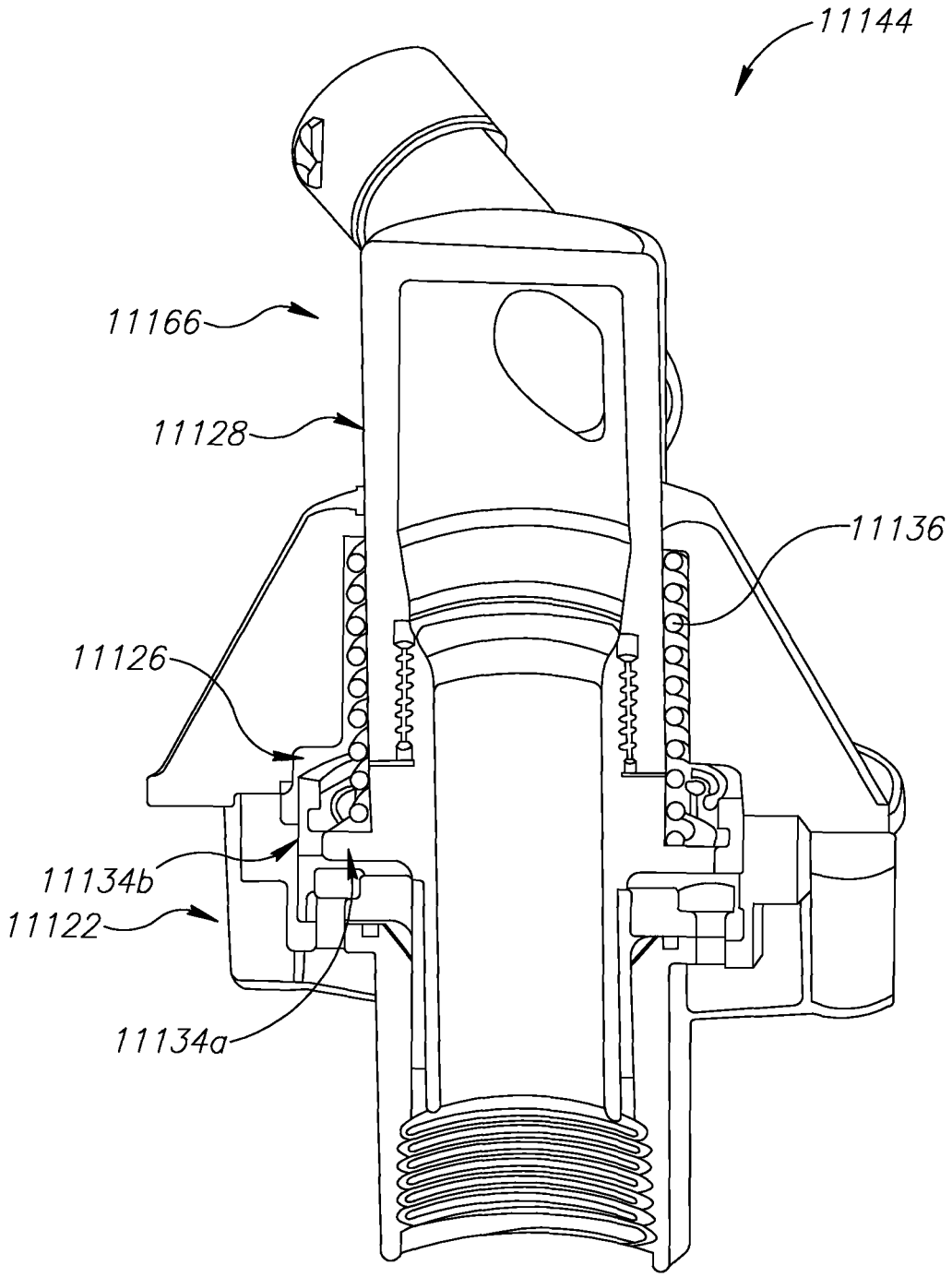
FIG. 10 shows a cross sectional view of the rotating sprinkler of FIG. 9.
Figure 11:
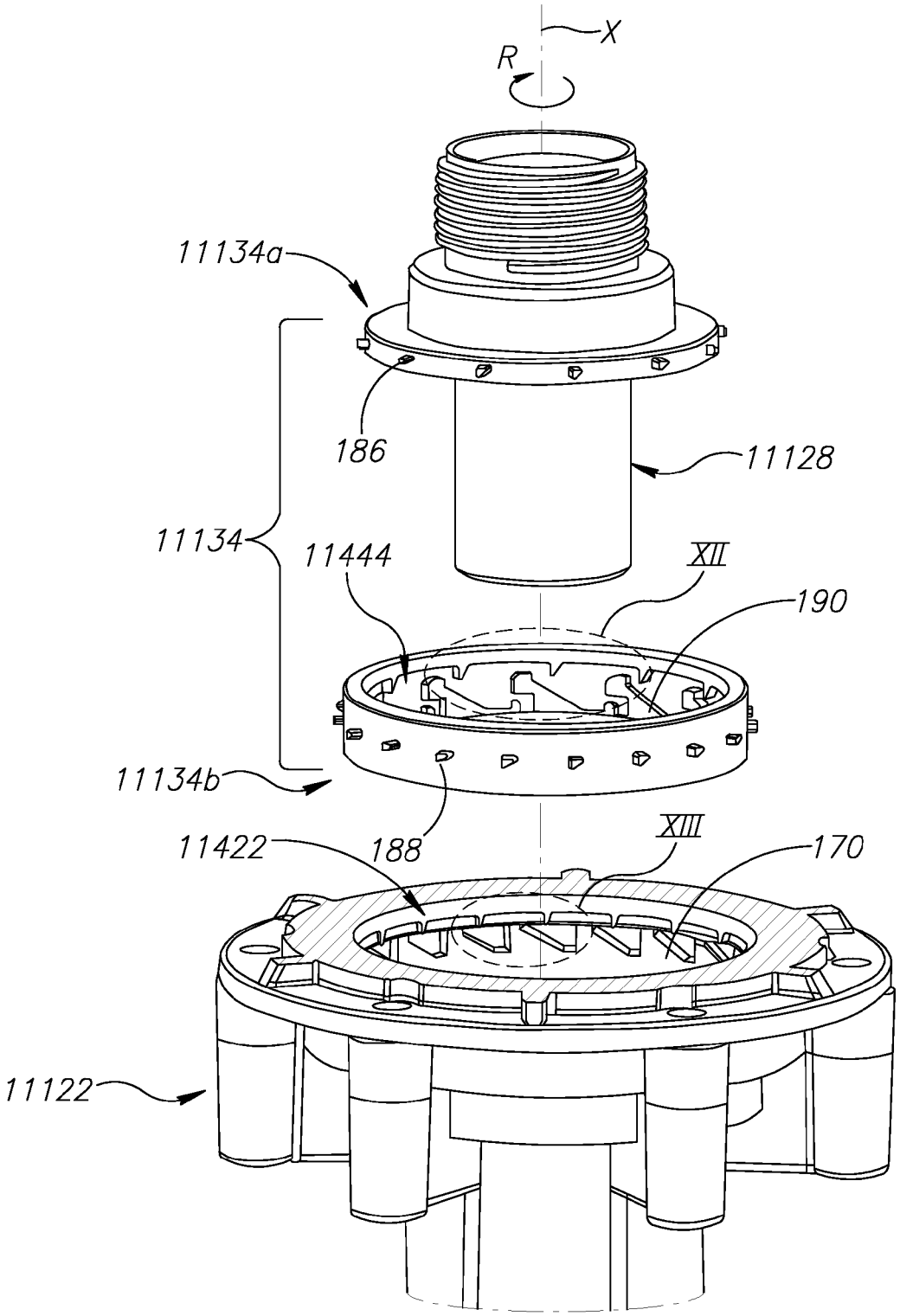
FIG. 11 shows an exploded view of a portion of the rotating sprinkler of FIG. 9.

Attention is now drawn to FIGS. 9 to 11. In an embodiment of the present invention, irrigation assembly 10 includes a rotating sprinkler 11144 in accordance with a third embodiment of the present invention. Sprinkler 11144 has a static portion 11122 and a rotating portion 11166 that is adapted to rotate in direction R about axis X of the assembly. Static portion 11122 is in the form of a housing with an inner face 170 that encloses a volume 11126, and volume 11126 opens out of static portion 11122 at an upper and a lower end of static portion 11122. The rotating portion of sprinkler 11144 includes a stem 11128 with a generally cylindrical hollow body. Stem 11128 extends through volume 11126 and protrudes upwards out of static portion 11122 towards a merge 11130 of the rotating portion. From merge 11130, two arms 11177 of rotating portion 11166 extend in directions away from axis X to respective nozzles 11188 of the rotating portion.

Figure 13:
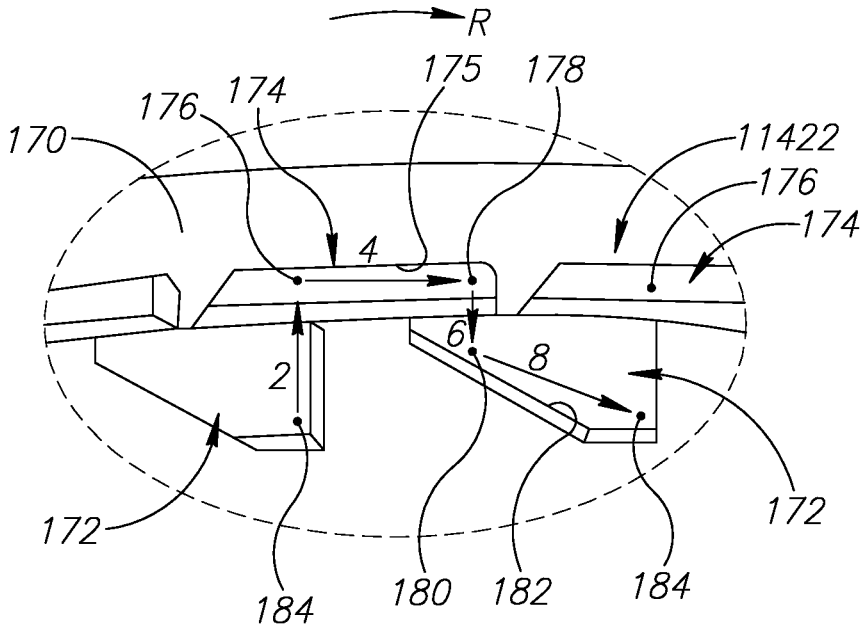

With attention additionally drawn to FIG. 13 it is seen that static portion 11122 has upon a cylindrical portion of its inner face 170 a set of grooved guiding teeth 11422 that are formed about axis X. Since FIG. 13 shows a section of inner face 170 and guiding teeth 11422 on the far side of face 170 behind axis X (see section marked in FIG. 11), arrow R representing the rotational direction of sprinkler 11144 about axis X points in this view to the right. Each guiding tooth in set 11422 has a lower bay 172 and an upper passage 174. Passage 174 includes a ceiling 175 (only one indicated) and spans in direction R about axis X from a start 176 to a termination 178 where it communicates with an entry 180 into bay 172. Entry 180 is located below termination 178. Bay 172 has a lower side 182 that slants downwards and in direction R from entry 180 to a bottom 184 of bay 172 that is located below a start 176 of a neighboring passage 174 of a subsequent guiding tooth in direction R.

With attention in particular drawn to FIG. 11 it is seen that sprinkler 11144 also includes a rotor 11134 formed of first and second members 11134*a*, 11134*b*. First member 11134*a* is formed as an annular shape that protrudes out of stem 11128 and which is fixed to rotate together stem 11128 and thereby with the rotating portion of sprinkler 11144. First member 11134*a* has a peripheral outer face with rotor teeth 186 that project radially out from that face. Second member 11134*b* is ring shaped with a peripheral outer face that is formed with rotor teeth 188 that project radially out from that outer face. Second member 11134*b* has also an inner cylindrical face 190 with a set of grooved guiding teeth 11444 that are formed upon inner face 190.

Figure 12:
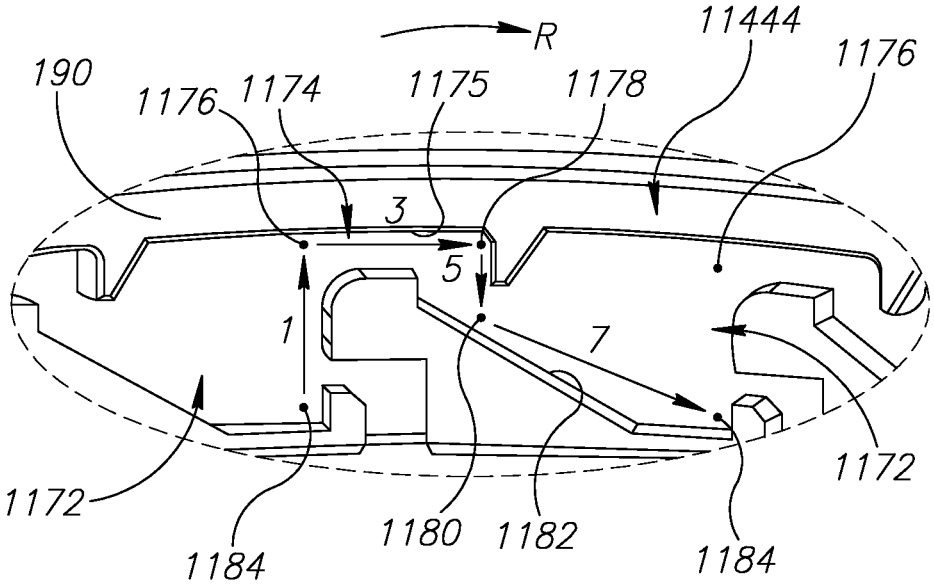
FIGS. 12 and 13 show sections of FIG. 11.

Attention is drawn to FIG. 12 that shows a section of second member 11134*b* showing inner face 190 and set 11444. As already mentioned with respect to FIG. 13, here too since FIG. 12 shows a section of inner face 190 and guiding teeth 11444 on the far side of face 190 behind axis X (see section marked in FIG. 11), arrow R representing the rotational direction of sprinkler 11144 about axis X points in this view to the right. The teeth in set 11444 are generally similar to those in set 11422 and include a lower bay 1172 and an upper passage 1174. Passage 1174 includes a ceiling 1175 (only one indicated) and spans in direction R about axis X from a start 1176 to and a termination 1178 where it communicates with an entry 1180 into bay 1172. Entry 1180 is located below termination 1178. Bay 1172 has a lower side 1182 that slants downwards and in direction R from entry 1180 to a bottom 1184 of bay 1172 that is located below the start 1176 of a neighboring passage 1174 of a subsequent tooth in direction R.

In sprinkler 11144, as best seen in FIG. 10, second member 11134*b* surrounds first member 11134*a* and is located between first member 11134*a* and inner face 170 of static portion 11122. The interaction between these parts is such that each rotor tooth 186 of first member 11134*a* is located in a respective guiding tooth of set 11444 of second member 11134*b*, and each rotor tooth 188 of second member 11134*b* is located in a respective guiding tooth of set 11422 of static portion 11122. Also it can be seen in FIG. 10 that sprinkler 11144 is provided with a spring 11136 that is pressed between an upper part of static portion 11122 and between first member 11134*a*, to thereby apply a downward biasing force upon first member 11134*a* and as a result upon the rotating portion of sprinkler 11144.

Attention is now drawn back to FIGS. 12 and 13 to discuss a rotational movement or step that sprinkler 11144 will perform when exposed to a given liquid pulse that is discharged from device 12 via sprinkler 11144 to the outside environment. The rotational movement or step that sprinkler

11144 will perform involves interaction between the first and second members of rotor 11134 and between static portion 11122. In FIG. 12 a path that a given rotor tooth 186 of first member 11134*a* will perform during such a step has been "tracked" and indicated by "dots" and "numbered arrows". And in FIG. 13 a path that a given rotor tooth 188 of second member 11134*b* will perform during such a step has also been "tracked" and indicated by "dots" and "numbered arrows".

In between liquid pulses or before starting an irrigation sequence that includes exposing system 10 to communication with pressure from the liquid source upstream, spring 11136 presses rotating portion 11166 downwards towards a retracted position maintaining the "tracked" rotor tooth 186 of first member 11134*a* at a bottom 1184 of a given bay 1172 in set 11444, and maintaining the "tracked" rotor tooth 188 of second member 11134*b* at a bottom 184 of a given bay 172 in set 11422.

As a liquid pulse begins to exit device 12 at a pressure sufficient to apply a force that overcomes spring 11136, stem 11128 together with first member 11134*a* will start to lift up and thereby move the "tracked" rotor tooth 186 along arrow 1 from bottom 1184 of bay 1172 to start 1176 of passage 1174 (see FIG. 12). Once reaching this position, first member 11134*a* that continues to rise will start urging second member 11134*b* to also lift up and thereby trail first member 11134*a* upwards. This will urge the "tracked" rotor tooth 188 of second member 11134*b* along arrow 2 from bottom 184 of bay 172 to start 176 of passage 174 (see FIG. 13). The upward movement of rotating portion 11166 will be stopped at this ejected position by the guiding teeth of static portion 11122 that do not permit further upward movement of the rotor teeth of second member 11134*b*.

The liquid pulse flowing through sprinkler 11144, when starting to be discharged to the outside environment via the nozzles of sprinkler 11144 will also start to urge the rotating portion of sprinkler 11144 to rotate about axis X (as already seen and discussed with respect also to FIG. 2B). The rotor teeth 186 that are fixed to rotating portion 11166 will start to rotate in direction R about axis X, and thereby the "tracked" rotor tooth 186 of first member 11134*a* will rotate along arrow 3 from start 1176 to termination 1178 of passage 1174 (see FIG. 12). Once reaching termination 1178, the rotating portion 11166 that is still being urged to rotate due to the moment force applied by the discharged liquid pulse, will urge second member 11134*b* to rotate together with it and thereby trail now first member 11134*a* in direction R.

This will urge the "tracked" rotor tooth 188 of second member 11134*b* along arrow 4 from start 176 to termination 178 of passage 174 (see FIG. 13). At termination 178, second member 11134*b* will stop its rotation about axis X because at this position the guiding teeth of static portion 11122 will not permit any further rotational movement of the rotor teeth of second member 11134*b* therein. This will in turn also not permit first member 11134*a* to further rotate about axis X. FIG. 2C that was previously discussed may be seen to represent the position of the rotating portion of sprinkler 11144 when both "tracked" rotor teeth 186, 188 are respectively maintained at their upward "parked" positions at terminations 1178, 178 by the liquid pulse that is still being emitted from device 12.

The liquid pulse exiting device 12 will continue to flow via sprinkler 11144 to be sprayed to the outside environment, while maintaining rotating portion 11166 at the upward "parked" stand still position just discussed (as also seen and discussed with respect to FIG. 2D). As the pulse reaches its end (or just before reaching its end), spring 11136 will urge first member 11134*a* downwards thereby moving "tracked" rotor tooth 186 from termination 1178 along arrow 5 to entry 1180 of a neighboring bay 1172 in direction R (see FIG. 12). When meeting lower side 1182 "tracked" rotor tooth 186 (together with the other teeth 186) will apply a downward force upon second member 11134*b* which will urge it to trail and move down and thereby move "tracked" rotor tooth 186 from termination 178 along arrow 6 to entry 180 of a neighboring bay 172 in direction R (see FIG. 13).

The rotational step that sprinkler 11144 performs about axis X during a given liquid pulse may be finalized by a terminal rotational movement of the rotating portion of sprinkler 11144 that is assisted by the downwardly biasing force of spring 11136 that urges engagement between the first and second members 11134*a*, 11134*b* and the lower slanted sides 1182, 182. The "tracked' rotor tooth 186 of first member 11134*a* will accordingly slide upon lower side 1182 and follow arrow 7 from entry 1180 to bottom 1184 (see FIG. 12), and the "tracked' rotor tooth 188 of second member 11134*b* will accordingly slide upon lower side 182 and thereby follow arrow 8 from entry 180 to bottom 184 (see FIG. 13). After completing this terminal rotational movement sprinkler 11144 will reach a position that is similar to that discussed and seen in FIG. 2E.

While a certain sequence of events has been described above with respect to the movements of the first and second members of sprinkler 11144, it is to be understood that this sequence may be altered due to, e.g., friction occurring between the moving parts of sprinkler 11144. For example, the upward movements of the first and second members 11134*a*, 11134*b* that are indicated by "arrow 1" and "arrow 2" may occur also generally simultaneously or, e.g., the upward movement of second member 11134*b* may start before first member 11134*a* has finished its movement indicated by "arrow 1". What should be noted however is that the overall movements of the first and second members 11134*a*, 11134*b* in a certain direction is equal to the sum of the movements that the members 11134*a*, 11134*b* perform in that direction. For example, the overall upward movement during exposure to a liquid pulse will be equal to the movement illustrated by "arrow 1"+the movement illustrated by "arrow 2".

By choosing appropriate dimensions for the passages 174, 1174 and bays 172, 1172; the angular rotational movement or step "theta" (that has also been seen and discussed with respect to FIG. 2F) that sprinkler 11144 performs about axis X during a given liquid pulse may be defined to be an angle that either derives an integer or does not derive an integer when 360° is divided by "theta". Liquid pulses being "fed" to an embodiment of sprinkler 11144 with an angle "theta" that does not derive an integer, will be sprayed to the outside environment along angular rotational movements or steps "theta" that do not repeat themselves in subsequent cycles (or revolutions) that sprinkler 11144 performs about axis X (i.e. do not for example stop at the same locations in subsequent revolutions). This will result in a more even and arbitrary distribution of sprayed liquid over an area of a field being irrigated by such an embodiment of sprinkler 11144. In a non binding example, a sprinkler 11144 may be provided with an angular step "theta" equal to about 48.95° so that 360° divided by such an angle "theta" will not provide an integer (in this example 360°/48.95° is equal to about 7.354 which is not an integer).

By way of another non-binding example, an embodiment of sprinkler 11144 may be designed with guiding teeth 11444, 11422 that are sized to facilitate the following movements along "numbered arrows" 1 to 8 seen in FIGS.

12 and 13. Movement along arrow 1 may be of about 3 mm, along arrow 2 about 3.2 mm, along arrow 3 about 4.1 mm, along arrow 4 about 5 mm, along arrow 5 about 1.8 mm, along arrow 6 about 2 mm, along arrow 7 about 3.8 mm and along arrow 8 about 4.3 mm. In cases where ceilings 175, 1175 slant upwards in a leading direction such slanting may be at an angle of about 8°, while lower sides 182, 1182 may be designed slanting downwards in a leading direction at an angle of about 30°. An example of sprinkler 11144 with the above dimensions and configurations may provide an angle "theta" of about 38.6° wherein dividing 360° by such a "theta" accordingly does not provide an integer.

While the invention has been illustrated and described in detail in the drawings and foregoing description, such illustration and description are to be considered illustrative or exemplary and non-restrictive; the invention is thus not limited to the disclosed embodiments. Variations to the disclosed embodiments can be understood and effected by those skilled in the art and practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures can not be used to advantage. Any reference signs in the claims should not be considered as limiting the scope.

Although the present embodiments have been described to a certain degree of particularity, it should be understood that various alterations and modifications could be made without departing from the scope of the invention as hereinafter claimed.

The invention claimed is:

1. A rotating sprinkler for use with a pulsating device,
the pulsating device being configured to form liquid pulses and each liquid pulse has a beginning when the pulse begins and an end when the pulse ends,
the sprinkler comprising a rotating portion configured to move in rotation about an axis, and configured to emit the liquid pulses to the outside environment, wherein
the rotating portion is configured to initially rotate during emission of each liquid pulse, the rotating portion is configured to stop rotating before the end of each liquid pulse, and
the rotating portion is configured to perform a terminal rotational movement after each liquid pulse,
wherein the stopping of rotation of the rotating portion will occur after no more than 85% of a pulse time Tp has passed, and wherein the pulse time Tp is a time measured between the beginning and the end of the pulse.

2. The rotating sprinkler according to claim 1, wherein the rotation of the rotating portion is urged by the pulses emitted to the outside environment.

3. The rotating sprinkler according to claim 1, wherein the liquid pulses urge the rotating portion to move along the axis.

4. The rotating sprinkler according to claim 3, wherein before or when starting to rotate the rotating portion moves up along the axis and after stopping to rotate the rotating portion moves down along the axis.

5. The rotating sprinkler according to claim 4 and comprising a biasing means adapted to urge the rotating portion to move down along the axis.

6. The rotating sprinkler according to claim 1, comprising also a static portion, and wherein movement of the rotating portion is controlled by interaction between the rotating and static portions.

7. A rotating sprinkler for use with a pulsating device,
the pulsating device being configured to form liquid pulses and each liquid pulse has beginning when the pulse begins and an end when the pulse ends,
the sprinkler comprising a rotating portion configured to move in rotation about an axis, and configured to emit the liquid pulses to the outside environment, wherein
the rotating portion is configured to initially rotate during emission of each liquid pulse, and
the rotating portion is configured to stop rotating before the end of each liquid pulse,
wherein the stopping of rotation of the rotating portion will occur after no more than 85% of a pulse time Tp has passed, and wherein the pulse time Tp is a time measured between the beginning and the end of the pulse,
the sprinkler further comprising first and second members, the first member being fixed to move together with the rotating portion, and the second member not being fixed to move together with the rotating portion along at least one of the rotational or axial direction,
wherein the rotation of the rotating portion during emission of a liquid pulse includes the second member moving along the rotational directions after the first member moves along the rotational direction.

8. The rotating sprinkler according to claim 1, wherein the rotating portion is adapted to stop rotating only once before the end of each liquid pulse.

9. The rotating sprinkler according to claim 1, wherein the stopping of rotation of the rotating portion will occur after no more than 75% of the pulse time Tp has passed, and wherein the pulse time Tp is a time measured between the beginning and the end of a pulse.

10. The rotating sprinkler according to claim 1, wherein an angular rotational movement of the rotating portion between beginnings of subsequent pulses is "theta", and wherein 360° divided by "theta" is not equal to an integer.

11. The rotating sprinkler according to claim 1, wherein the rotating portion comprises a merge positioned along the axis, at least one arm extending from the merge in a direction away from the axis, and a nozzle positioned at the distal end of each arm.

12. The rotating sprinkler according to claim 1, wherein the rotating portion further comprises a disk-shaped rotor that extends at least partially about the axis and in a radial outward direction away from the axis, the rotor having rotor teeth on at least one of the upper and lower sides of the disk-shaped rotor.

13. The rotating sprinkler according to claim 12, wherein the disk-shaped rotor has a first member and a second member, the first member rotatable separate from the second member, the first member having rotor teeth on one of the upper and lower sides thereof and the second member having rotor teeth on the other of the upper and lower sides thereof.

14. The rotating sprinkler according to claim 1, wherein the rotating portion includes a stem having a disk-shaped first member with a least one rotor tooth on a peripheral surface thereof, an annular second member surrounds the first member, the second member having a set of grooved guiding teeth on an inner surface thereof, the second member being capable of rotating relative to a static portion of the sprinkler.

* * * * *